US006257970B1

(12) United States Patent
Huber

(10) Patent No.: US 6,257,970 B1
(45) Date of Patent: Jul. 10, 2001

(54) ERGONOMICALLY FRIENDLY RANDOM ORBITAL CONSTRUCTION

(75) Inventor: Paul W. Huber, Lancaster, NY (US)

(73) Assignee: Hao Chien Chao, South Pasadena, CA (US)

( * ) Notice: Subject to any disclaimer, the term of this patent is extended or adjusted under 35 U.S.C. 154(b) by 0 days.

(21) Appl. No.: 09/408,192

(22) Filed: Sep. 29, 1999

Related U.S. Application Data

(63) Continuation-in-part of application No. 08/787,873, filed on Jan. 23, 1997, now Pat. No. 6,004,197.

(51) Int. Cl.[7] ..... B24B 23/04
(52) U.S. Cl. ..... 451/357; 451/344
(58) Field of Search ..... 451/344, 357, 451/359, 353

(56) References Cited

U.S. PATENT DOCUMENTS

| | | | | |
|---|---|---|---|---|
| D. 269,845 | | 7/1983 | Hutchins | D8/62 |
| D. 314,125 | | 1/1991 | Ogawa et al. | D8/62 |
| D. 326,398 | | 5/1992 | Fushiya et al. | D8/62 |
| D. 332,734 | | 1/1993 | Fushiya et al. | D8/62 |
| D. 334,126 | | 3/1993 | Huber et al. | D8/62 |
| D. 347,561 | | 6/1994 | Huber et al. | D8/62 |
| D. 350,266 | | 9/1994 | Huber et al. | D8/62 |
| D. 350,886 | | 9/1994 | Huber et al. | D8/62 |
| 2,114,966 | | 4/1938 | Myers . | |
| 3,673,744 | | 7/1972 | Oimoen . | |
| 3,785,092 | | 1/1974 | Hutchins | 51/170 |
| 3,793,781 | | 2/1974 | Hutchins | 51/170 |
| 3,970,110 | | 7/1976 | Schaedler et al. | 137/613 |
| 4,071,981 | | 2/1978 | Champayne . | |
| 4,268,233 | | 5/1981 | Fernstrom . | |
| 4,414,781 | | 11/1983 | Overy et al. . | |
| 4,467,565 | * | 8/1984 | Wallace et al. | 451/357 |
| 4,531,329 | | 7/1985 | Huber . | |
| 4,660,329 | | 4/1987 | Hutchins . | |
| 4,671,019 | | 6/1987 | Hutchins . | |
| 4,729,194 | * | 3/1988 | Maier et al. | 451/357 |
| 4,854,085 | | 8/1989 | Huber . | |
| 4,879,847 | | 11/1989 | Butzen et al. . | |
| 4,986,036 | * | 1/1991 | Hutchins | 451/344 |

(List continued on next page.)

FOREIGN PATENT DOCUMENTS 345521 3/1988 (TW) .

OTHER PUBLICATIONS

The Aro Corporation, Operator's Manual, Random Orbital Sander, Oct. 16, 1990—4 pages.

*Primary Examiner*—Eileen P. Morgan
(74) *Attorney, Agent, or Firm*—Joseph P. Gastel

(57) ABSTRACT

A random orbital sander including a housing, a motor having a vertical axis in the housing, a pad coupled to the motor, a face on the pad extending substantially perpendicularly to the vertical axis, a shroud surrounding the pad, an opening in the shroud, and a dust discharge tube having an inner end in communication with the opening and an outer end on the dust discharge tube end extending at an acute angle to the face of the pad. The sander has a height of between 83 and 86 millimeters and can weigh between 0.68 and 0.75 kilograms. The outer end of the dust discharge tube can extend between about 120 and 157 millimeters from the vertical centerline. A compressed air valve including a first cylindrical wall, a first bore in the first wall, a valve having a base with a second cylindrical wall in engagement with the first cylindrical wall, a second bore in the cylindrical wall, and an inclined surface in the second wall in communication with the second bore. A bore in the motor shaft conducts compressed air which is supplied to the motor through the chamber housing the bearings which support the spindle which mounts the pad.

39 Claims, 14 Drawing Sheets

U.S. PATENT DOCUMENTS

| | | | |
|---|---|---|---|
| 5,040,340 | 8/1991 | Bischof et al. . | |
| 5,105,585 | 4/1992 | Hampl et al. . | |
| 5,125,190 | 6/1992 | Buser et al. . | |
| 5,228,244 | 7/1993 | Chu . | |
| 5,319,888 | 6/1994 | Huber et al. . | |
| 5,411,386 | 5/1995 | Huber et al. . | |
| 5,531,639 | 7/1996 | Catalfamo . | |
| 5,536,199 | 7/1996 | Urakami . | |
| 5,538,040 | 7/1996 | Huber et al. . | |
| 5,595,530 | 1/1997 | Heidelberger . | |
| 5,713,785 | 2/1998 | Nishio . | |
| 5,791,979 | 8/1998 | Duncan et al. | 451/456 |

* cited by examiner 10
11
12
13
15
17
105
106
108
87
80
90
3
1A 10
11
12
13
14
15
17
22
71
81
87
80
93
94
95
105
106
107
108
110
2A
3
a
b 109
90
87
12
92
91
93
95
94
80
11
81
89
86
12
83
85
147
145
107
109
143
142
144
105
84
88
17
10
15
22
13
14
70
a
b Fig. 11.
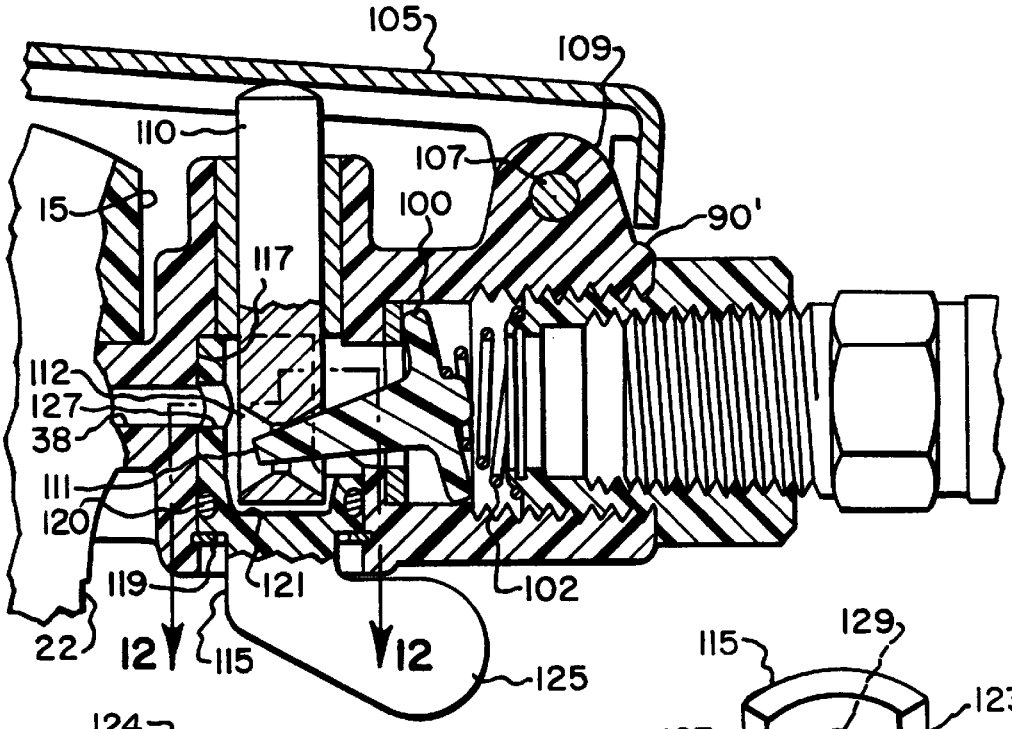
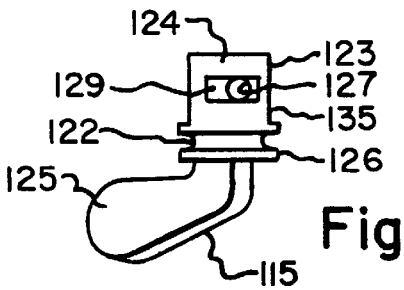
Fig. 11B.
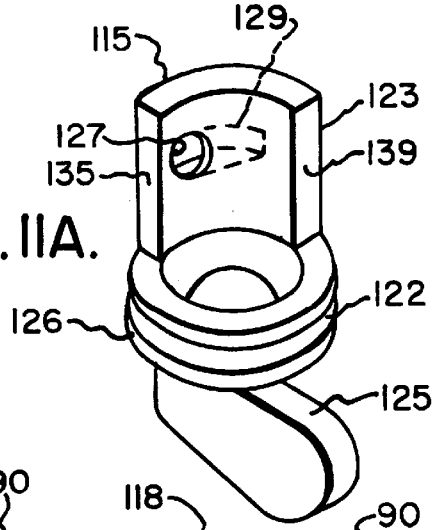
Fig. 11A.
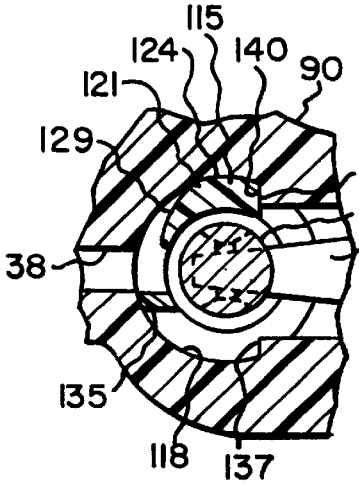
Fig. 12.
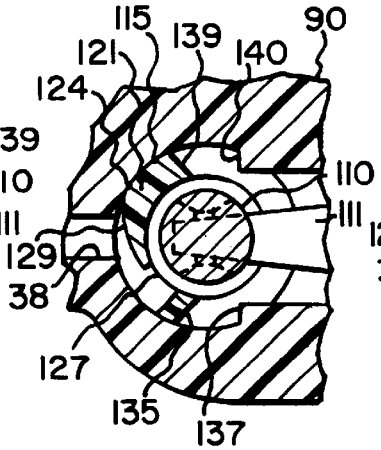
Fig. 13.
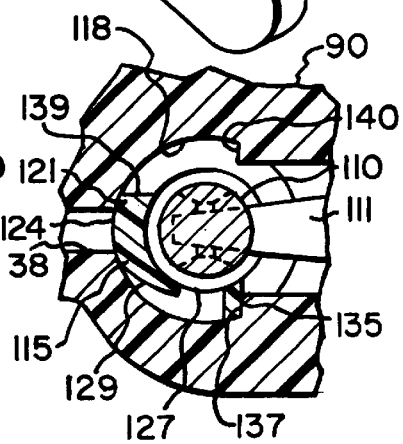
Fig. 14.

ERGONOMICALLY FRIENDLY RANDOM ORBITAL CONSTRUCTION

CROSS-REFERENCE TO RELATED APPLICATIONS

The present application is a continuation-in-part of application Ser. No. 08/787,873, filed Jan. 23, 1997, now U.S. Pat. No. 6,004,197.

STATEMENT REGARDING FEDERALLY SPONSORED RESEARCH OR DEVELOPMENT

Not Applicable

BACKGROUND OF THE INVENTION

The present invention relates to an improved ergonomically friendly surface-treating tool in which a flat surface of a rotary pad engages the surface of a workpiece for the purpose of abrading or polishing it and more particularly to an improved random orbital sander.

By way of background, in operation, random orbital sanders create forces at the sanding surface which are transmitted back to the operator's hand and arm through a lever which is the height of the random orbital sander between the face of the sanding disc and the top of the casing at the vertical centerline of the sander. Therefore, if this height is as short as possible, the operator's effort in overcoming the forces produced at the face of the sanding disc are less than if the height was greater. In addition, there is a second force which must be overcome by the operator, namely, the force produced by the flexible dust discharge hose which acts through a lever arm having a length between the vertical centerline of the orbital sander and the outer end of the dust discharge fitting which conveys dust from the shroud. When any one of the foregoing two dimensions are lessened, the effort required by the operator in using an orbital sander is accordingly lessened. Also, it has been observed that lower heights of the compressed air inlet connection and the dust discharge tube outlet above a sanding surface result in less effort to operate the sander. When all of the foregoing distances are lessened, the effort involved in using the orbital sander is all the more lessened.

Furthermore, in the past the outer end of the dust discharge tube always accepted a flexible dust carrying hose at a horizontal attitude. This had the disadvantage that the horizontal dust carrying hose could droop downwardly and contact external bodies relatively close to the sander with the attendant creation of frictional drag which the operator had to overcome. In addition, when the outer end of the dust discharge tube was relatively far from the vertical centerline of the sander there was a relatively long lever arm through which the force created by the flexible hose at the outer end of the dust discharge tube acted.

In addition, insofar as known, in the past a fitting was utilized at the outer end of the dust discharge tube which effectively increased the length of the dust discharge tube and thus increased the dimension between the vertical centerline of the sander and the outer end of the dust discharge fitting with the attendant increase of the lever arm through which the force exerted by the flexible dust discharge tube acted.

In addition, insofar as known, the compressed air inlet valve structure was not capable of providing small increments of adjustment to the rotary speed of the sander.

In the type of random orbital sanders using central vacuum systems to carry away the abrasives and foreign particles, a high volume of air is drawn through the housing. This causes eddy currents at the various sharp edges including the edges of the eccentric housing which contains the bearings which mount the spindle to which the pad is attached. Abrasives and foreign particles may thus enter the bearing area because they are sucked in to this area because of changes in positive and negative pressures due to the operation of the tool. One attempt to reduce the amount of foreign matter entering the bearing area is shown in U.S. Pat. No. 4,854,085 which utilized a triple seal. This approach did increase the bearing life to a certain degree.

BRIEF SUMMARY OF THE INVENTION

It is one object of the present invention to provide an improved random orbital sander which possesses a plurality of structural features which include a relatively low height and a relatively short inclined dust discharge tube which contribute toward making the sander ergonomically friendly.

Another object of the present invention is to provide an improved random orbital sander which possesses the structural characteristics of the immediately preceding paragraph and also possesses a lower compressed air inlet which further contributes toward making the sander ergonomically friendly.

A further object of the present invention is to provide an improved random orbital sander in which the relatively short dust discharge tube is angled upwardly, thereby further contributing to the ergonomically friendliness of the sander.

A still further object of the present invention is to provide an improved compressed air inlet valve construction which permits small increments of adjustability of the speed of the orbital sander.

Yet another object of the present invention is to provide the dust discharge fitting which is attached to the shroud with an outer end which is internally threaded which receives a flexible hose directly without requiring a special fitting mounted at the outer end of the dust discharge fitting, thereby shortening the lever arm through which the connected end of the flexible hose acts.

Another object of the present invention is to provide an improved structural arrangement for essentially preventing foreign matter from entering the spindle bearing area of a random orbital sander and thus prolonging the life of the bearings to a much greater extent than was heretofore possible by the use of seals.

Other objects and attendant advantages of the present invention will readily be perceived hereafter.

The present invention relates to a surface-treating tool comprising a housing, a motor having a vertical axis in said housing, a pad coupled to said motor, a face on said pad extending substantially perpendicularly to said vertical axis, a shroud surrounding said pad, an opening in said shroud, a dust discharge tube having an inner end in communication with said opening, and an outer end on said dust discharge end extending at an acute angle to said face of said pad.

The present invention also relates to a surface-treating tool comprising a housing having a top, an air motor having a vertical axis in said housing, said motor including a cylinder and rotor and end plates and a shaft, an eccentric on said shaft, and a pad having a face coupled to said eccentric, said surface-treating tool having a height along said vertical axis between said top and said face of said pad which is less than about 86 millimeters.

The present invention also relates to a surface-treating tool comprising a housing having a top, an air motor having a vertical axis in said housing, said motor including a cylinder and rotor and end plates and a shaft, an eccentric on said shaft, and a pad having a face coupled to said eccentric, said surface-treating tool having a weight of less than about 0.75 kilograms.

The present invention also relates to a compressed air flow control valve for a surface-treating tool having a housing, an air motor in said housing, and a compressed air conduit extending through said housing in communication with said air motor, the compressed air flow control valve structure being in communication with said compressed air conduit and comprising a housing unit, a first bore having a first cylindrical wall surface in said housing unit in communication with said compressed air conduit, a valve in said first bore, a base on said valve in engagement with said first cylindrical wall surface, a second wall having an outer cylindrical surface extending outwardly from said base in complementary sliding circumferential engagement with said first cylindrical wall surface, a second bore in said second wall for selective communication with said compressed air conduit, and an inclined groove on said outer cylindrical surface extending away from said second bore.

The present invention also relates to a random orbital action surface-treating tool comprising a housing, a compressed air motor in said housing, a shaft in said motor, a rotor mounted on said shaft, compressed air ducts in said motor for conducting compressed air to said rotor, an eccentric housing mounted on said shaft, a chamber in said eccentric housing, at least one bearing in said eccentric housing, and ducts within said housing between said compressed air ducts and said chamber.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 11 is an enlarged fragmentary enlarged cross sectional view similar to FIG. 7 but showing the compressed air inlet valve in an open position;

FIG. 11A is an enlarged perspective view of the compressed air flow control valve;

FIG. 11B is a side elevational view of the compressed air flow control valve;

FIG. 12 is a fragmentary cross sectional view taken substantially along line 12—12 of FIG. 11 and showing the relationship between the position between the compressed air inlet valve and the air flow adjusting valve when the latter is in a fully open position;

FIG. 13 is a view similar to FIG. 12 but showing the relationship when the air flow adjusting valve is in a partially open position;

FIG. 14 is a view similar to FIG. 12 but showing the relationship when the air flow adjusting valve is in a closed position;

DETAILED DESCRIPTION OF THE INVENTION

There are three basic types of random orbital sanders in use. The first and most rudimentary type is the non-vacuum type which does not have any vacuum associated with it for the purpose of conveying away the dust which is generated during a sanding operation. The second type is the central vacuum type which has a vacuum hose attached at one end to a central vacuum source and at its other end to a fitting which is in communication with the shroud of the sander so as to create a suction which carries away the dust which is generated during a sanding operation. The third type is a self-generated vacuum type wherein the exhaust air from the air motor is associated with an aspirator in communication with the shroud for carrying away the dust which is generated during a sanding operation.

Summarizing in advance, each of the foregoing types of random orbital sanders has one or more improved features of the present invention. First of all, all of the random orbital sanders have a relatively low height, which thus reduces stresses experienced by the operator. Additionally, all of the types are relatively lightweight to thereby further lessen the effort required to use it. In addition, the central vacuum type includes an inclined dust discharge tube connected to the shroud of the sander which causes the flexible discharge hose leading to the central vacuum source to be inclined at an angle away from the sander to thereby tend to avoid frictional drag of the flexible hose on surfaces adjacent to the sanding surface. Also, the flexible hose is threaded directly into the inclined dust discharge tube, thereby lessening the distance between the outer end of the dust discharge tube and the end which would normally be used if an additional fitting were required between the dust discharge tube and the flexible hose. The self-generated vacuum type has all of the foregoing structural features and in addition includes an aspirator which is in a straight line with the major portion of the dust discharge tube, thereby permitting the dust discharge tube to operate relatively efficiently.

Figure 1:
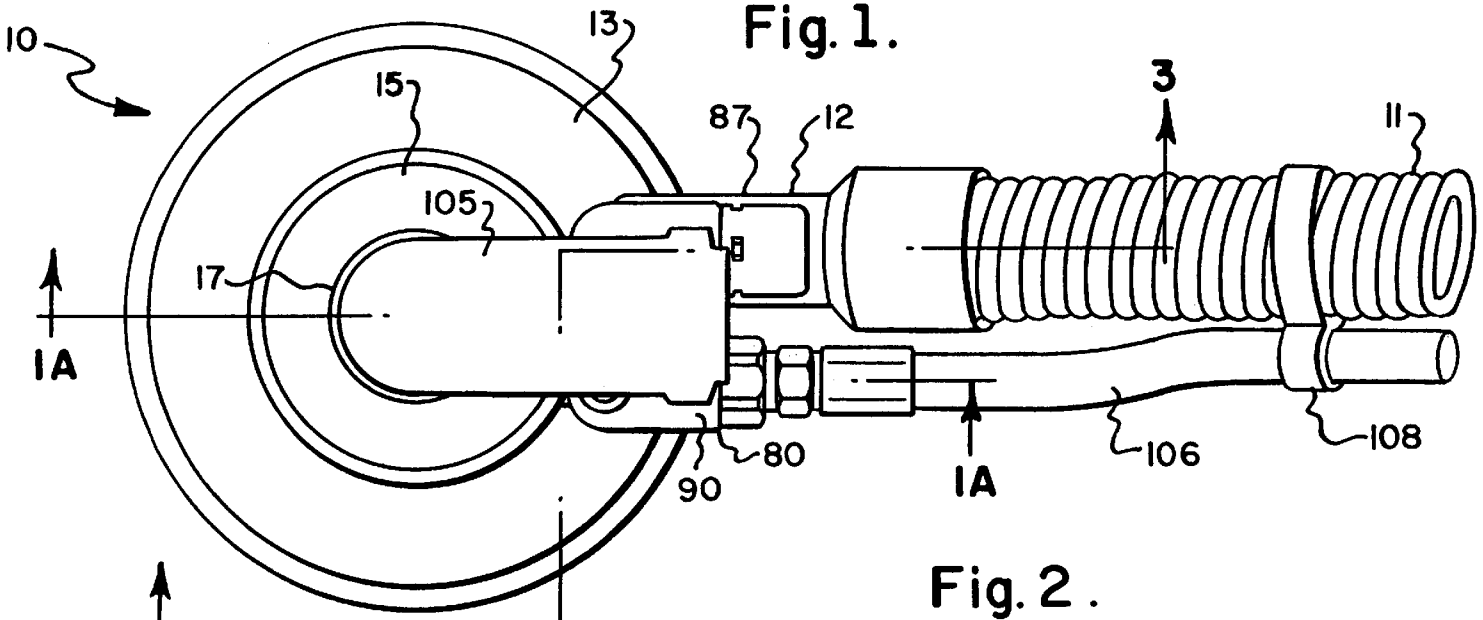
FIG. 1 is a fragmentary plan view of a central vacuum orbital sander with the vacuum hose and the compressed air hose connected to the orbital sander and to each other.
Figure 2:
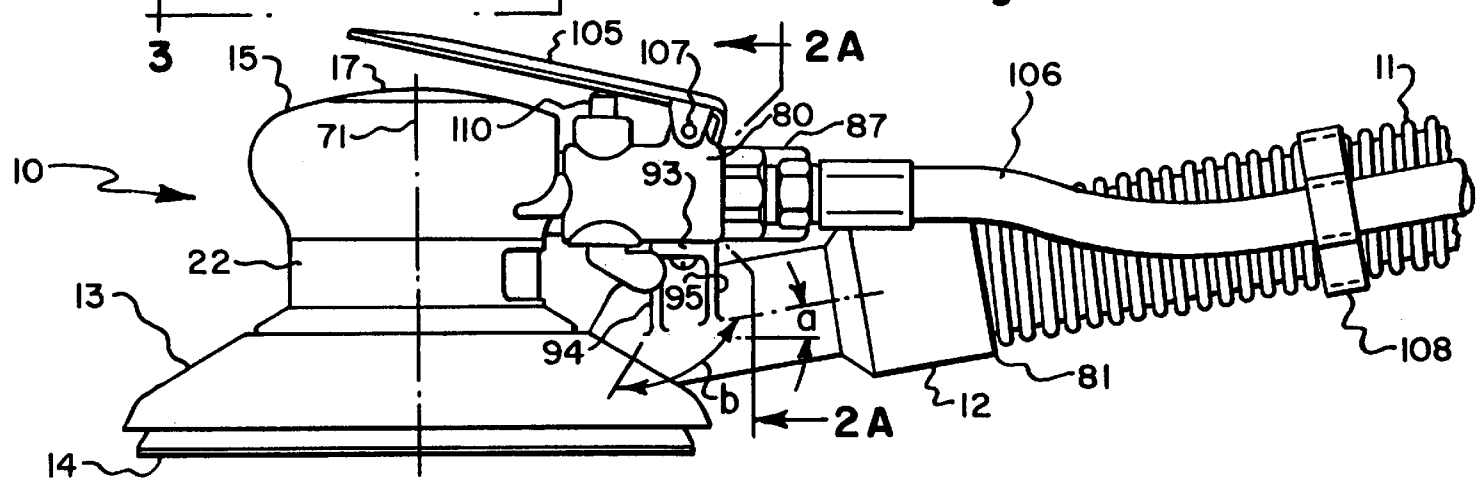
FIG. 2 is a fragmentary side elevational view of the orbital sander of FIG. 1.
Figure 1A:
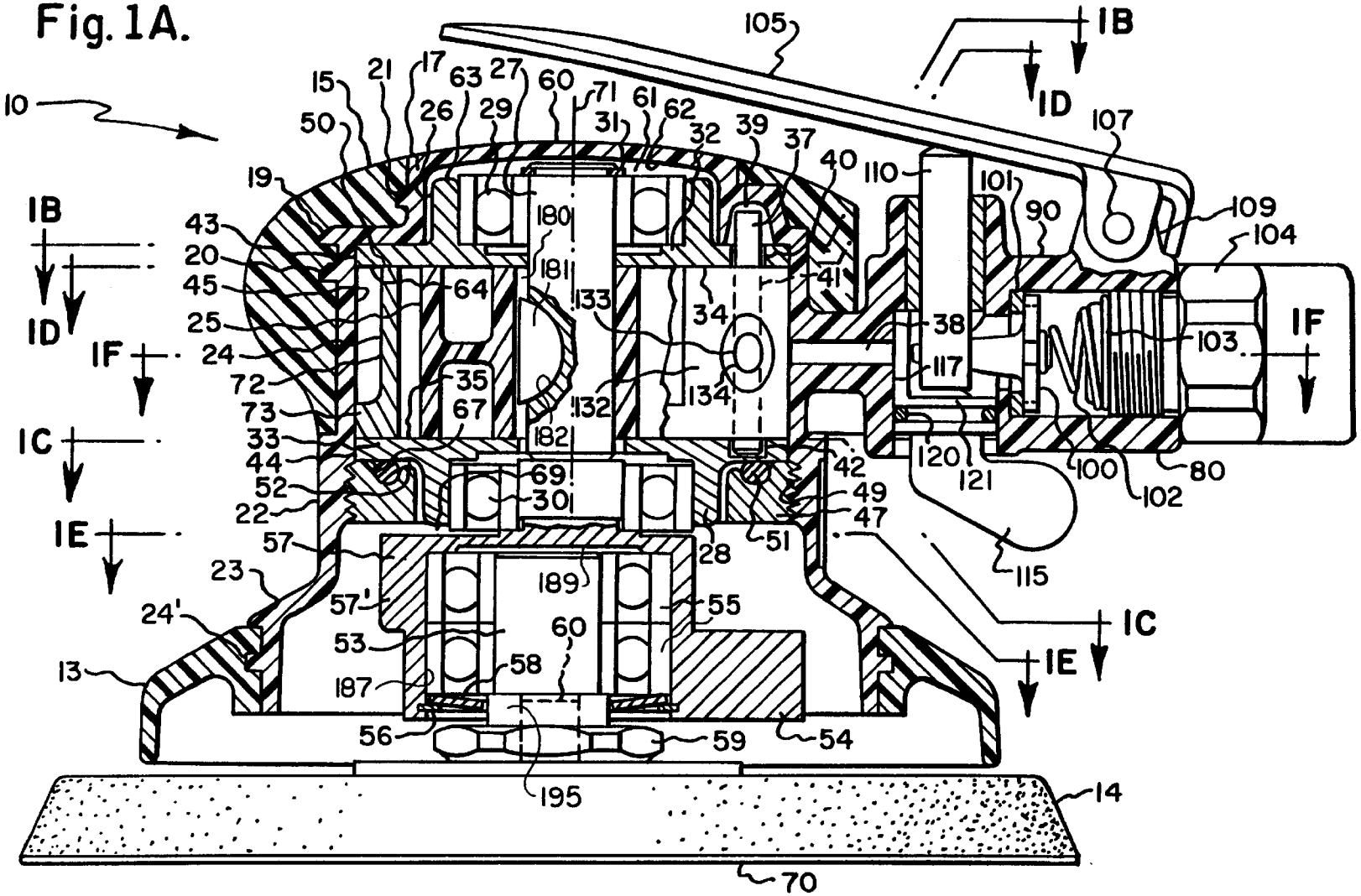
FIG. 1A is an enlarged fragmentary cross sectional view taken substantially along line 1A—1A of FIG. 1.

In FIGS. 1, 1A, 2, 2A, 2B and 3 a central vacuum type of random orbital sander 10 is disclosed wherein a flexible vacuum hose 11 is connected between the dust discharge tube 12 and the shroud 13 which surrounds the sanding disc 14. However, the only difference between the central vacuum type orbital sander 10 and a non-vacuum type is that the latter does not have the dust discharge tube 12 or the flexible hose 11. The basic structure which is common to all three types of orbital sanders is shown in FIG. 1A which is taken along line 1A—1A of FIG. 1.

The basic construction includes a housing grip 15 of a rubber type material which is mounted on plastic housing 17 and secured thereon by coacting with ribs 19, 20 and 21 which extend partially around housing 17. Housing 17 also includes a lower portion 22 which terminates at a skirt 23 having an annular rib 24' thereon onto which flexible plastic shroud 13 is mounted with a snap fit.

An air motor is located within housing 17, and it includes a cylinder 24 in which a rotor 25 keyed to shaft 27 by key 28 is mounted. The ends of shaft 27 are mounted in bearings 29 and 30 (FIG. 1A), and a snap ring 31 retains shaft 27 in position. The cylinder 24 is part of a cylinder assembly which includes an upper plate 32 and a lower plate 33. The bearing 29 is mounted into annular portion 63 of upper plate 32, and the bearing 30 is mounted into annular portion 28 of lower plate 33. The end plates 32 and 33 include planar surfaces 34 and 35, respectively, which bear against the ends of cylinder 24 to thereby provide the required sealing with the adjacent portions of the cylinder 24. A pin 37 has an upper end which is received in a bore 39 in housing 17. Pin 37 passes through a circular bore 40 in end plate 32 and through a bore 41 in cylinder 24 and into a bore 42 in end plate 33, thereby aligning the end plates 32 an 33 with the cylinder 24. The outer circular ends 43 and 44 of end plates 32 and 33, respectively, have a tight fit with the internal surface 45 of housing 17. A threaded lock ring 47 is threaded into tapped portion 49 of housing 17 to thus cause the upper surface 50 of end plate 32 to bear against the adjacent surface of housing 17. An O-ring 51 in a groove in lock ring 47 bears against the undersurface 52 of lower end plate 33. Rotor shaft 27 has an eccentric housing 57 formed integrally therewith into which bearings 55 are mounted and retained therein by snap ring 56 which bears on Belleville washer 58. Housing 57 is an eccentric having two counter-weights 54 and 57'. A stub shaft 53 is press-fitted into bearings 55 and it is formed into a nut 59 at its outer end. Thus, rotor shaft 27 will rotate and eccentric housing 57 will simultaneously rotate with shaft 27. A threaded shaft 60 extends upwardly from sanding disc 14 and is received in stub shaft 53.

Figure 1B:
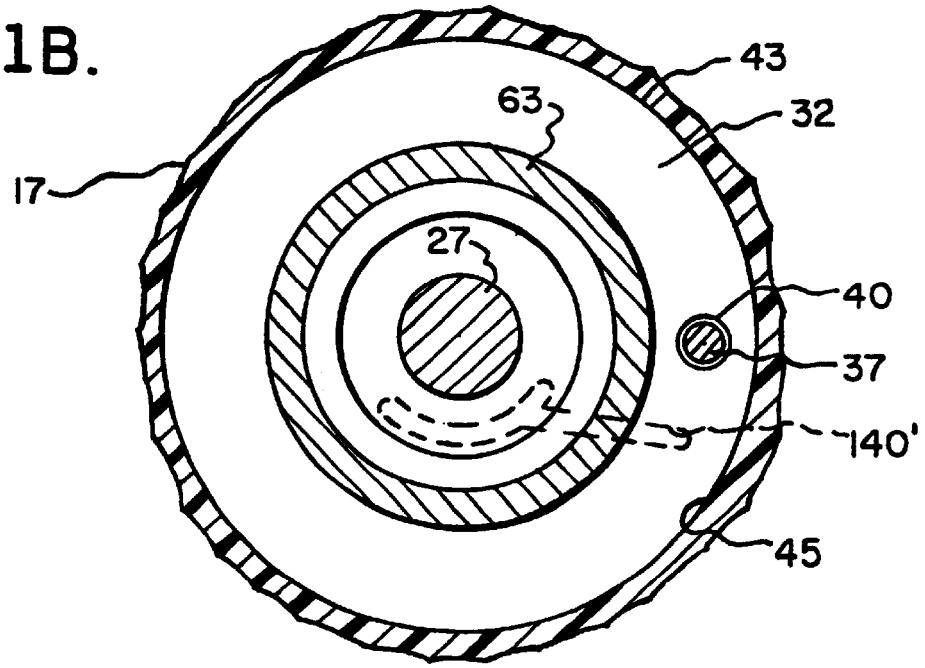
FIG. 1B is a cross sectional view taken substantially along line 1B—1B of FIG. 1A.
Figure 1D:
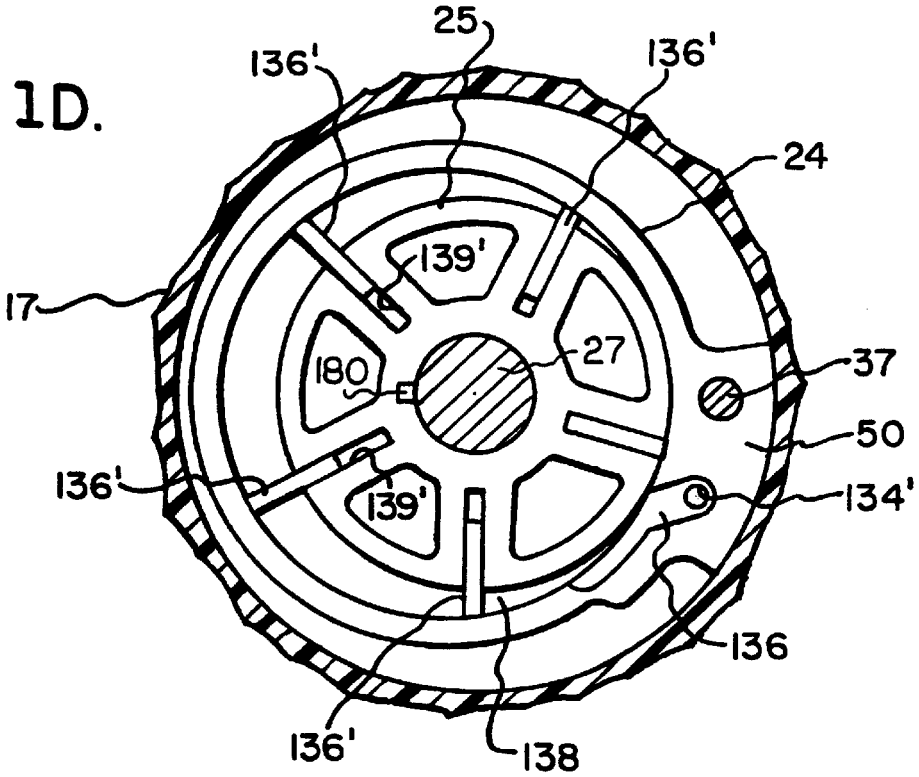
FIG. 1D is a cross sectional view taken substantially along line 1D—1D of FIG. 1A.
Figure 1C:
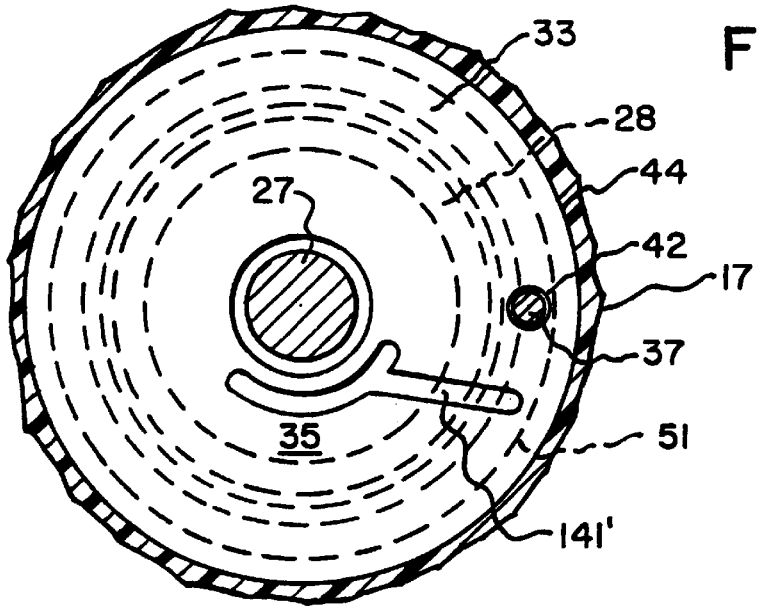
FIG. 1C is a cross sectional view taken substantially along line 1C—1C of FIG. 1A.
Figure 1E:
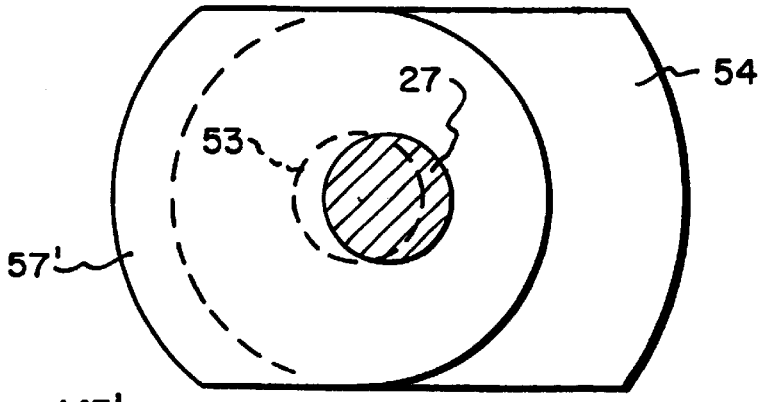
FIG. 1E is a cross sectional view taken substantially along line 1E—1E of FIG. 1A.
Figure 1F:
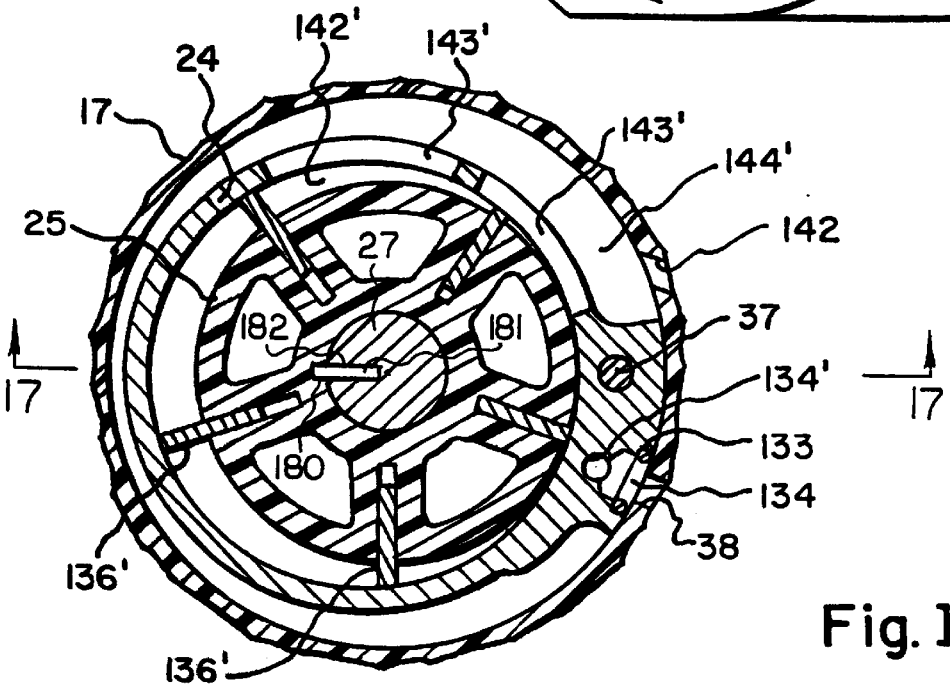
FIG. 1F is a cross sectional view taken substantially along line 1F—1F of FIG. 1A.

As can be seen from FIGS. 1A and 1F a compressed air inlet conduit 38 is in communication with bore 134 in cylinder 24, and bore 134 is in communication with bore 134' which extends axially between upper cylinder surface 50 (FIG. 1D) and lower cylinder surface 35 (FIG. 1A). Bore 134' is in communication with groove 136 (FIG. 1D) in upper cylinder surface 50 and a like groove (not shown) in lower cylinder surface 35. When upper plate 32 is in assembled position, it causes groove 136 to be a conduit leading to chamber 138 (FIG. 1D) within cylinder 24. Lower plate 33 forms a similar conduit with the groove which corresponds to groove 136 in lower cylinder surface 35. A plurality of vanes 136' (FIG. 1D) are slidably mounted in radial slots 139' in plastic rotor 25 and their outer ends contact the inner surface of cylinder 24 because they are forced outwardly by air pressure which is conducted to the inner ends of slots 139' by groove 140' (FIG. 1B) in the surface 64 of plate 32. Groove 140' is in communication with groove 136. Lower plate 33 (FIG. 1C) has a groove 141' which corresponds to groove 140' and is in communication with a groove which corresponds to groove 136. Air is exhausted from chamber 142' of cylinder through narrow slots 143' (FIG. 1F) a few millimeters wide in the central portion of cylinder 24, and this exhaust air passes into chamber 144' between cylinder 24 and housing 17, and it thereafter passes through bore 142 (FIGS. 1F and 3) into exhaust conduit 87.

Figure 5:
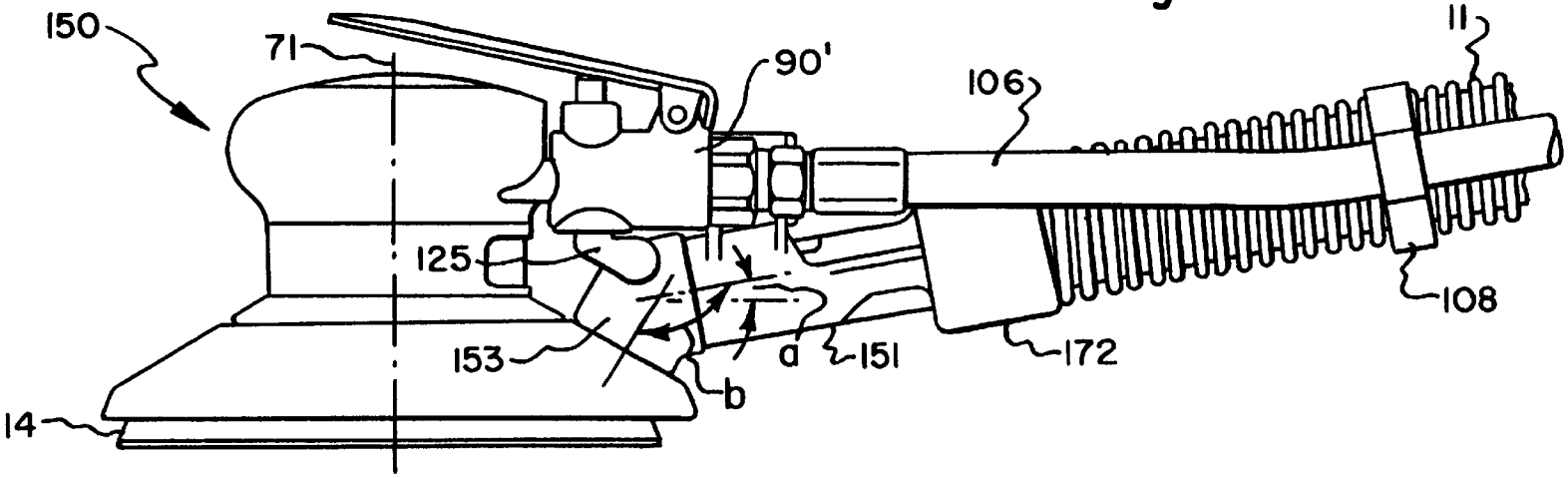
FIG. 5 is a fragmentary side elevational view of the sander of FIG. 4.
Figure 6:
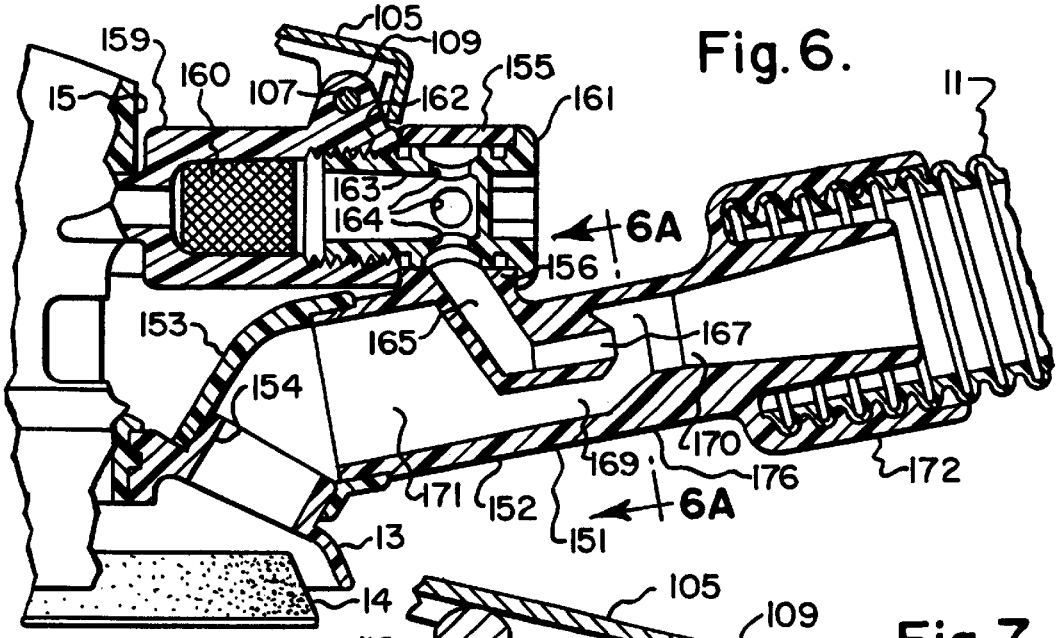
FIG. 6 is an enlarged fragmentary cross sectional view taken substantially along line 6—6 of FIG. 5 and showing the structure of the motor exhaust tube, the dust discharge tube containing an aspirator, the connection therebetween and the connection between the dust discharge tube and the flexible hose.
Figure 6A:
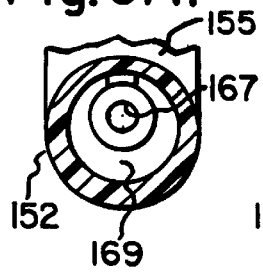
FIG. 6A is a cross sectional view taken substantially along line 6A—6A of FIG. 6.

At this point it is to be noted that the air motor is of a conventional type which has been constructed for causing the overall height of the above-described unit in FIG. 5 to be lower than existing orbital sanders having a similar construction and for causing it to have a lower weight.

The modifications which have been made are as follows: The top 60 of housing 17 is 2.0 millimeters thick. Additionally, the clearance at 61 between the inner surface 62 of housing 17 and the edge 63 is 0.6 millimeters. In addition, the thickness of end plate 32 between surface 50 and surface 64 is 2.5 millimeters, and the thickness of end plate 33 between surface 35 and surface 67 is 2.5 millimeters. The cylinder 24' has an axial length of 20 millimeters. In addition, the clearance 69 is 0.5 millimeters. Also, nut 59 is 4.0 millimeters thick. The eccentric has a height of 21.4 millimeters. All of the foregoing dimensions have caused the air motor to have a height of 82.92 millimeters from the top of housing 17 to the face 70 of pad 14 at the vertical centerline 71. This compares to the lowest known existing prior art structure which has a height of approximately 89 millimeters to thereby reflect a difference of 6.08 millimeters meters or approximately 7%. In addition, the use of aluminum end plates 32 and 33, rather than steel, plus having the outer surface 72 of cylinder 24 to be 2 millimeters and the absence of an upper flange which corresponds to flange 73 and the thinning of aluminum end plate 33 and the thinning of nut 59 reduces the weight of the orbital sander of FIG. 5 to 0.68 kilograms as compared to a similar prior art sander which has a weight of 0.82 kilograms, thereby reflecting a difference of approximately 0.14 kilograms or about 17%. As noted above, the lesser weight makes it easier for a person to handle the orbital sander.

As noted above, the air motor is a well known conventional type having 150 watts minimum power at 0.61 bar air pressure minimum. The above features of the presently described air motor cause the orbital sander to be of a relatively low height and a relatively low weight. Otherwise, the internals of the air motor are conventional.

Figure 15:
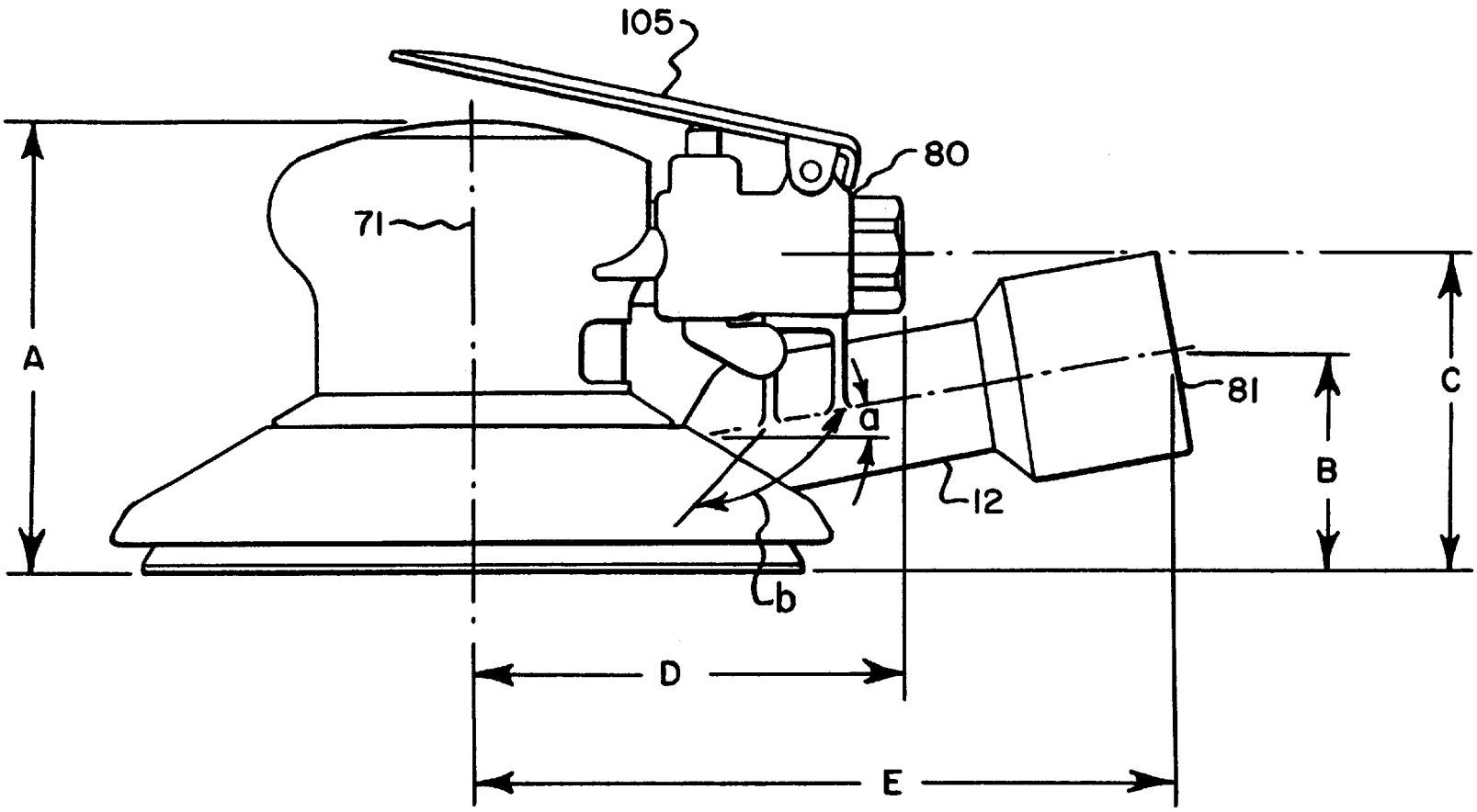
FIG. 15 is a side elevational view of a central vacuum type orbital sander showing the various dimensions which are considered in determining ergonomics.

The reduced height of sander 10 is depicted by letter A in FIG. 15. The fact that the entire height of sander 10 is lower, results in the lowering of the centerline of the outlet of the dust discharge tube to a dimension B and also results in the lowering of the centerline of the compressed air inlet 80 to a dimension C. As noted above, the lowering of dimensions B and C also results in enhancing the ease of handling of the orbital sander 10.

Figures 2A, 2B, 3:
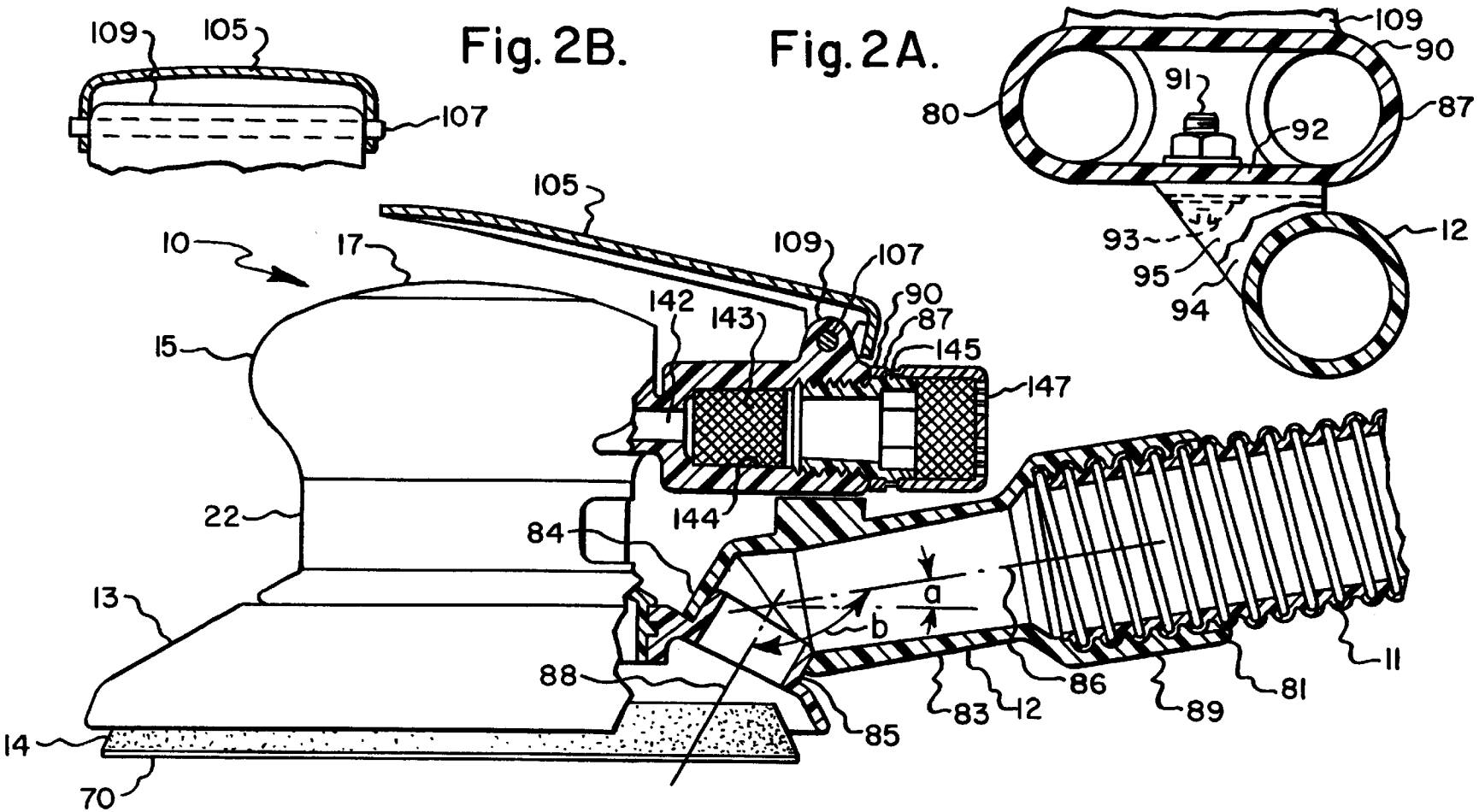
FIG. 2A is a fragmentary cross sectional view taken substantially along line 2A—2A of FIG. 2 and showing the support structure for the dust discharge tube.
FIG. 2B is a fragmentary extension of the top of the structure shown in FIG. 2A.
FIG. 3 is a fragmentary view, partially in cross section, taken substantially along line 3—3 of FIG. 1, and showing the relationship between the shroud and the dust discharge tube and the discharge hose; and also showing the relationship between the motor exhaust tube and the dust discharge tube.
Figure 4:
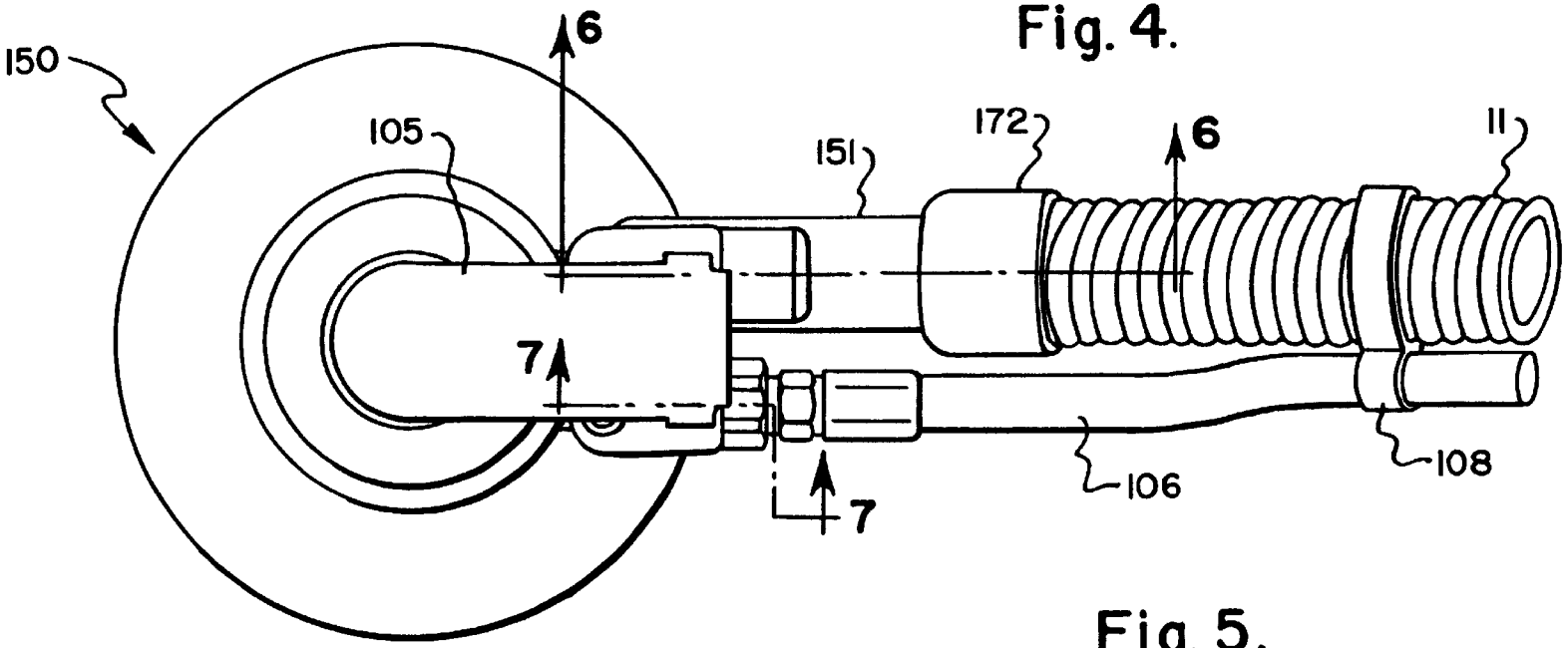
FIG. 4 is a fragmentary plan view of a self-generated vacuum orbital sander with the vacuum hose and the compressed air hose connected to the orbital sander and to each other.

In accordance with another aspect of the present invention, the dust discharge tube 12 (FIG. 3) of sander 10 has a centerline 86 and is inclined to the horizontal at an angle a. The dust discharge tube 12 consist of a longer section 83 and a shorter section 84 which has a centerline 88 and which has a circular outlet which mounts on cylindrical stub pipe 85 formed integrally with shroud 13. The dust discharge tube portion 83 is located immediately below the motor exhaust inlet fitting 87. The air motor exhaust conduit 87 is within housing portion 90 which is molded integrally with housing 17. Housing portion 90 also contains compressed air inlet conduit 80 (FIGS. 1 and 2A). The dust discharge tube 12 is also attached to housing portion 90 by a bolt 91 which extend through horizontal portion 92 of unit 90 and also extends through web 93 which spans legs 94 and 95 molded integrally with dust discharge tube 12. Thus, dust discharge tube 12 is firmly supported on stub tube 85 and on housing portion 90 which contains the air motor exhaust conduit 87 and the compressed air inlet 80.

As noted briefly above, since the outer end portion 89 (FIG. 3) of dust discharge tube 12 is inclined upwardly, the adjacent portion of flexible vacuum hose 11 will also be inclined upwardly to thus cause it to droop further away from the outlet 89 then if the latter was horizontal. This tends to lessen the possibility that the flexible hose will contact the workpiece which could create a frictional drag. In addition, as can be seen from FIG. 2, since the flexible hose 11 is received directly in dust discharge tube 12, a fitting which is otherwise used at the outer end of a dust discharge tube in the prior art is eliminated which thus causes the extreme outer end 81 of discharge tube 12 to be at a distance E (FIG. 15) from the vertical centerline 71 of the sander. It will be appreciated that the shorter that the distance E is, the shorter is the lever arm tending to tilt the sander 10 and thus for any given weight at the outer end 81 of dust discharge tube 12, the shorter the lever arm E is, the lower will be the tilting force which is produced and the lower will be the force required by the operator to overcome this tilting force.

In accordance with another aspect of the present invention, the compressed air inlet structure permits a very gradual varying of the pressure which is supplied to the air motor. In this respect, the compressed air inlet 80 includes a valve 100 (FIG. 1A) which is biased against seat 101 by spring 102 which has its outer end 103 bearing against the end of hollow compressed air fitting 104 which is threaded into housing portion 90. Fitting 104 (FIGS. 1, 2, 4 and 5) receives the end of compressed air hose 106 with a conventional connection. Hose 106 is attached to vacuum hose 11 by strap 108. In order to open valve 100 from the position shown in FIGS. 1A and 7 to the position shown in FIG. 11, lever 105 is pivotally mounted at 107 on boss 109 which is molded integrally with housing portion 90. When lever 105 is depressed, it will depress pin 110 from the position shown in FIG. 7 to the position shown in FIG. 9 against the bias of spring 102 in view of the fact that the extension 111 of valve 100 is received in a bore 112 at the lower end of pin 110. When lever 105 is released, the spring 102 will return valve 100 to the position of FIG. 7 and pin 110 will be raised to the position of FIG. 7 by virtue of its connection with valve extension 111. The foregoing structure of valve 100 is conventional.

Figure 7:
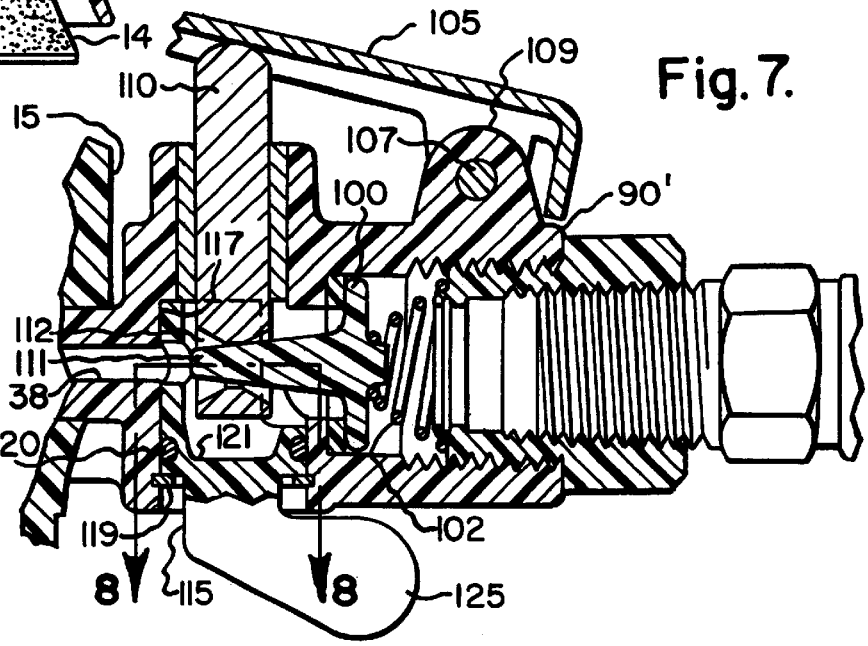
FIG. 7 is a fragmentary enlarged cross sectional view taken substantially along line 7—7 of FIG. 4 and showing the compressed air valve inlet structure.

In accordance with the present invention, an improved flow adjusting valve 115 (FIGS. 1A, 7, 11A and 11B) is located in bore 117 of housing portion 90 and it is retained therein by snap ring 119 (FIG. 7). Bore 117 has a wall 118. An O-ring 120 is mounted in a groove 122 of base 126 of valve body 121 (FIG. 11A). O-ring 120 performs both a sealing function and a frictional holding function to retain valve 115 in any adjusted position in bore 117. The valve consists of a portion 123 of a cylinder extending upwardly from base 126 and having an outer cylindrical surface 124. A handle 125 is molded integrally with valve body 121. The upstanding wall 123 includes an aperture 127 and an inclined groove 129 in communication with bore 127. The outer surface 124 is in sliding contact with wall 130 of bore 117. When valve 121 is in a fully open position shown in FIG. 8, bore 127 is in communication with bore 38 (FIG. 1A) of housing 17. Bore 38 terminates at wall 132 of air motor cylinder 25. An O-ring 133 is inserted in wall 132 (FIG. 1F) around bore 134 which provides a seal with the outer end of conduit 38. The foregoing structure is well known in the art.

Figure 8:
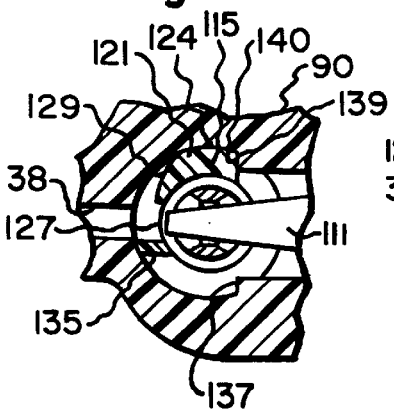
FIG. 8 is a fragmentary cross sectional view taken substantially along line 8—8 of FIG. 7 and showing the compressed air flow adjusting valve in a full open position.
Figure 9:
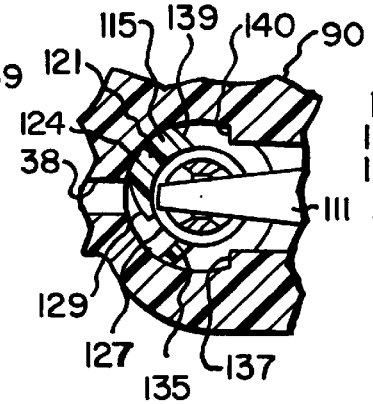
FIG. 9 is a view similar to FIG. 8 but showing the valve in a partially open position.
Figure 10:
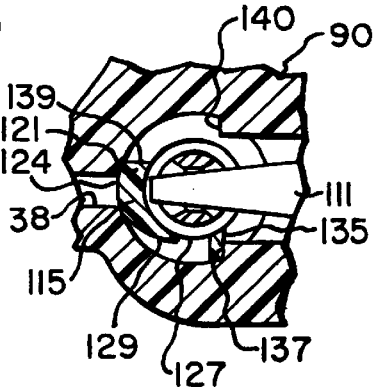
FIG. 10 is a view similar to FIG. 8 and showing the valve in a fully closed position.

As noted above, valve 115 is fully open in the position shown in FIG. 8. In FIG. 9 it is partially open and it can thus be seen that the air flow must pass along inclined groove 129 which restricts the opening to conduit 38. It will be appreciated that the more that wall 121 is moved in a counterclockwise direction, the smaller will be the path of communication leading to duct 38. In FIG. 10 the valve is shown in a fully closed position wherein the wall 124 completely closes off duct 38. At this time the edge 135 engages shoulder 137 to define the limit of counterclockwise movement of valve 115, as shown in FIG. 10. The clockwise limit of movement of wall 124 is determined when edge 139 engages shoulder 140, as shown in FIG. 10. The range of movement of valve 125 is 90° from a full open position to a full closed position.

FIGS. 12, 13 and 14 correspond to FIGS. 8, 9 and 10, respectively, but are taken along cross section line 12—12 above valve extension 111 whereas FIGS. 8, 9 and 10 are taken through valve extension 111 in FIG. 7.

In FIG. 3 motor air exhaust housing 87 is shown which is in communication with the exhaust of air motor cylinder 24 (FIG. 1A) through conduit 142 (FIG. 3). Housing 90 includes a muffler 143 which is held in position in bore 144 by plug 145 and the exhaust air exits housing 90 through perforated cap 147.

In FIGS. 4, 5, 6 and 7 a self-generated vacuum random orbital sander 150 is shown. This sander has the same internal structure described above relative to the central vacuum type, as shown in FIG. 1A. In addition, it has the same type of sanding pad 14 and it has the same type of valve 115 described above which is located in housing unit 90. The inlet valve 115 is identical to valve 125 described above in FIGS. 1A, 8, 9 and 10.

In accordance with another aspect of the present invention, the self-generated vacuum random orbital sander 150 includes a dust discharge tube 151 which is also inclined to the horizontal at an angle a (FIG. 5). Dust discharge tube 151 includes an elongated portion 152 which has a centerline 156 (FIG. 16) and is received in elbow 153 which has a centerline 158 and which in turn is mounted on stub pipe 154 of shroud 13. A tubular strap portion 155 is formed integrally with portion 156. Motor exhaust unit 159 contains a porous muffler 160. A fitting 161 extends through strap 155 and is threaded into motor exhaust housing 159 at 162 and it includes a bore 163 and a plurality of apertures leading from bore 163 to conduit 165 which is the entry portion of bore 167 which functions as an aspirator 176 in conjunction with the areas 169 and 170 of elongated dust discharge tube portion 150. It is to be especially noted that the dust discharge from shroud 13 enters the straight portion of dust discharge tube 152 and the fact that there is no sharp bend in the immediate vicinity of areas 171 and 169, there will be greater efficiency than if such a bend existed immediately adjacent to conduit 165.

In addition to the foregoing, the flexible dust discharge hose 11 is received in the enlarged portion 172 at the outer end of dust discharge tube 151 in the same manner as described above relative to the embodiment of FIGS. 1–3. The outer portion 170 of aspirator 176 is nested within the innermost portion of dust discharge hose 11 (FIG. 6), thereby contributing to the overall relative shortness of dust discharge tube 151.

It is to be noted that the dust discharge tube 151 is inclined at an angle a to the horizontal and that elbow 153 is inclined at an angle b to the horizontal.

Figure 16:
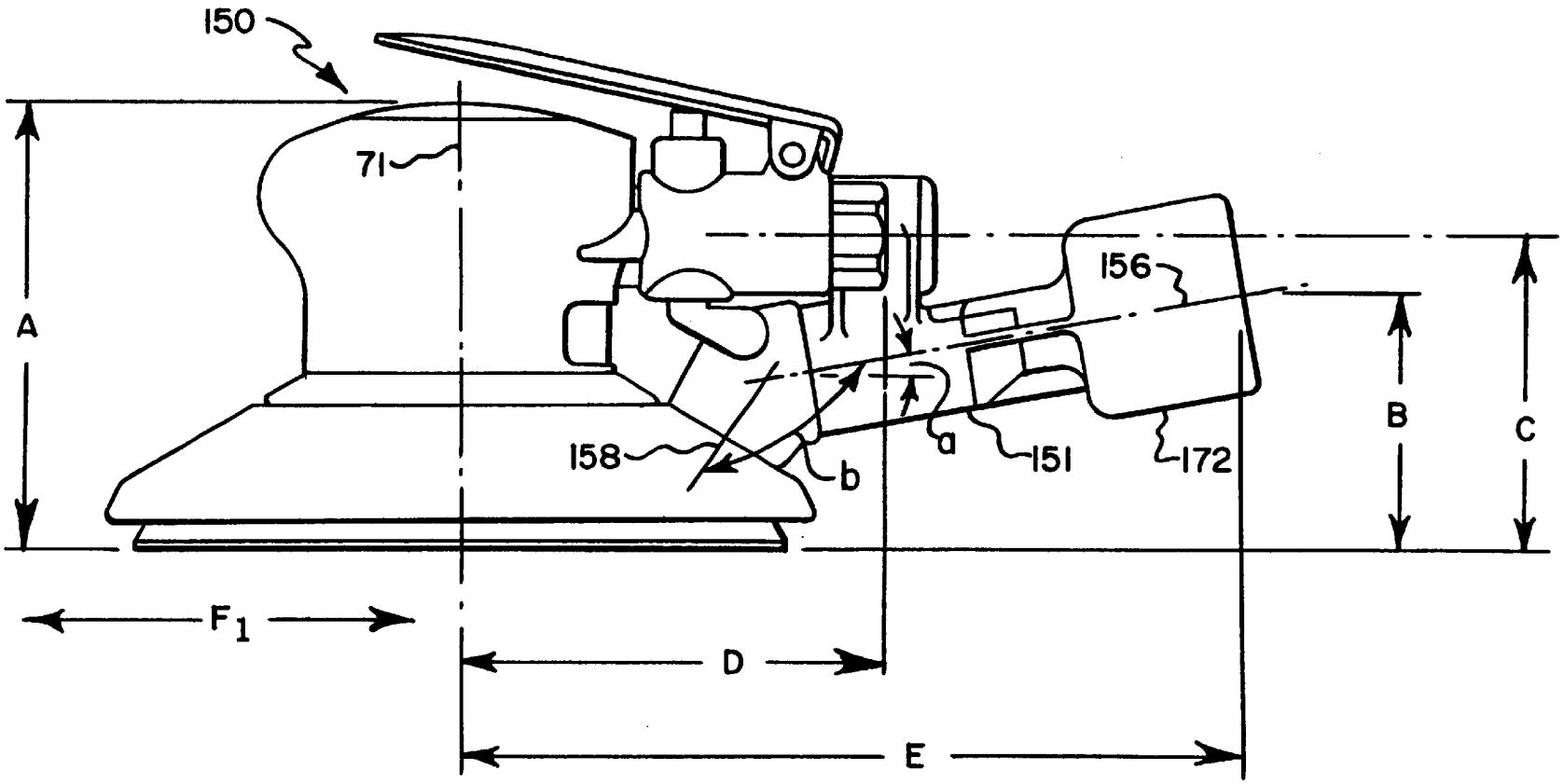
FIG. 16 is a side elevational view of a self-generated vacuum type of orbital sander showing the various dimensions which are considered in determining ergonomics.

It is to be further noted from FIG. 16 that the centerline of dust discharge tube 151 at the outer end of portion 172 is a distance E from the vertical centerline 71 of the random orbital sander 150. Dust discharge tube 151, in addition to being inclined, is relatively short so that any downward force at its outer end will be relatively close to the vertical centerline 71 and will therefore create less of a force which the operator must oppose than if it were longer.

The following table sets forth the dimensions A through E and angles a and b shown in FIGS. 15 and 16.

TABLE

DIMENSIONS IN MILLIMETERS OF VARIOUS PORTIONS OF DIFFERENT TYPES OF ORBITAL SANDERS

| | NON-VACUUM | SELF-GENERATED VACUUM | CENTRAL VACUUM |
|---|---|---|---|
| A | 82.92 | 82.92 | 82.92 |
| B | — | 47.45 | 40.42 |
| C | 58.42 | 58.42 | 58.42 |
| D | 80.00 | 80.00 | 80.00 |
| E | — | 147.28 | 130.05 |

TABLE-continued

DIMENSIONS IN MILLIMETERS OF VARIOUS PORTIONS OF DIFFERENT TYPES OF ORBITAL SANDERS

| | NON-VACUUM | SELF-GENERATED VACUUM | CENTRAL VACUUM |
|---|---|---|---|
| Angle a | — | 10° | 10° |
| Angle b | — | 130° | 130° |

A is the height between top of sander and sanding disc pad surface at vertical centerline of sander.
B is the height between centerline of discharge tube and sanding disc pad surface at outlet of discharge tube.
C is the height between centerline of compressed air inlet and sanding disc pad surface.
D is the horizontal distance between vertical centerline of sander and extreme outer portion of compressed air inlet.
E is the horizontal distance between vertical centerline of sander and extreme outer portion of the dust discharge tube.
Angle a is the angle between the horizontal, or the face of the pad, and the centerline of the dust discharge tube.
Angle b is the angle between the centerlines of the two portions of the dust discharge tube.

In the above table, the dimension E is 130.05 millimeters for the central vacuum sander and 147.28 millimeters for the self-generated vacuum sander. However, if the threaded connection at outer end portion 89 (FIG. 3) of dust discharge tube 12 of the central vacuum sander is decreased by two threads at 5 millimeters each, then the 130.05 dimension E would be decreased about 10 millimeters to about 120 millimeters. Also, if the threaded end portion 172 of the self-generated vacuum sander is decreased by two threads at 5 millimeters each, the 147.28 dimension E would be decreased 10 millimeters to about 137 millimeters. It is possible with a slight loss of ergonomics to lengthen the dimension E for the central vacuum and self generated vacuum sanders by about 10 millimeters to about 140 millimeters and about 157 millimeters, respectively. However, when the foregoing lengthened dimensions E are considered in combination with the lower height dimension A, each of the foregoing sanders will still be more ergonomically friendly than sanders not having this combination of dimensions.

As noted briefly above, the closest known prior art sander of the above-described type has a height dimension of approximately 89 millimeters as compared to height dimension A of 82.92 millimeters of the above-described sander. As further noted above there is a difference of about 7% between the two dimensions. The 82.92 millimeter dimension is the ultimate low dimension which was able to be achieved while still retaining the various component parts of the sander in a commercially operable manner for providing the desired output parameters noted above and also recited hereafter. However, it will be appreciated that the height dimension A of the present sander can be increased a few millimeters by not reducing the thickness and height of the various components as much as was done. Accordingly, it is contemplated that the height dimension A can be increased to 86 millimeters which would still be a reduction in height from 89 millimeters or approximately 3.5%.

Additionally, as noted above the closest known prior art sander of the present type has a weight of 0.82 kilograms as compared to the weight of the present sander of 0.68 kilograms, or a difference of 0.14 kilograms or a weight reduction of approximately 17%. It will be appreciated that the weight of the sander of the present invention may be increased to 0.75 kilograms which would be a difference of approximately 0.07 kilograms, and this would be a weight reduction of approximately 8.3% which also could be significant.

The preferred angle a shown above in the table is an acute angle of 10°. However, this angle may be as small as about 5° and as high as about 30°. The exact acute angle for any specific device will depend on various factors such as the length of the motor exhaust body which is located directly above it and the vertical spacing between the shroud outlet and the motor exhaust body.

As noted above, the angle b is 130°, but it can be any obtuse angle consistent with the acute angle a of the dust discharge tube.

The non-vacuum sander, the central vacuum sander 10 and the self-generated vacuum sander 150 utilize a 150 watt power air motor which operates from a source providing 6.1 bar air pressure and the air motor is capable of providing up to 10,000 revolutions per minute.

In accordance with another aspect of the present invention, the bearings 55 (FIGS. 1A and 17) are supplied with compressed air and a one-way valve which prevents foreign matter from effectively entering the eccentric housing 57 in which they are located. In this respect, it is to be noted from FIGS. 1A, 1B, 1C, 1D and 1F that compressed air is conducted from bore 38 (FIGS. 1A and 1F) through bore 134 and into bore 134'. The compressed air then passes into groove 136 (FIG. 1D) in cylinder surface 50 and a counterpart groove (not shown) in cylinder surface 35. The compressed air then passes through groove 140' (FIG. 1B) in surface 64 of plate 32 from groove 136, and it also passes through groove 141' (FIG. 1C) from the counterpart (not shown) of groove 136. As expressed above, the compressed air emanating from grooves 140' and 141' enter the radial slots 139' (FIG. 1D) of the rotor 25 to force vanes 136' outwardly.

There is a working clearance between the parts of air motor consisting of cylinder 24 and rotor 25 and plates 32 and 33. Thus the compressed air from grooves 140' and 141' will pass between plate 32 and rotor 25 and will also pass between plate 33 and rotor 25. This compressed air will then enter rotor keyway slot 180 (FIGS. 1A, 1D and 1F), and then pass around key 181 which is located in key slot 182 in shaft 27.

Figure 17:
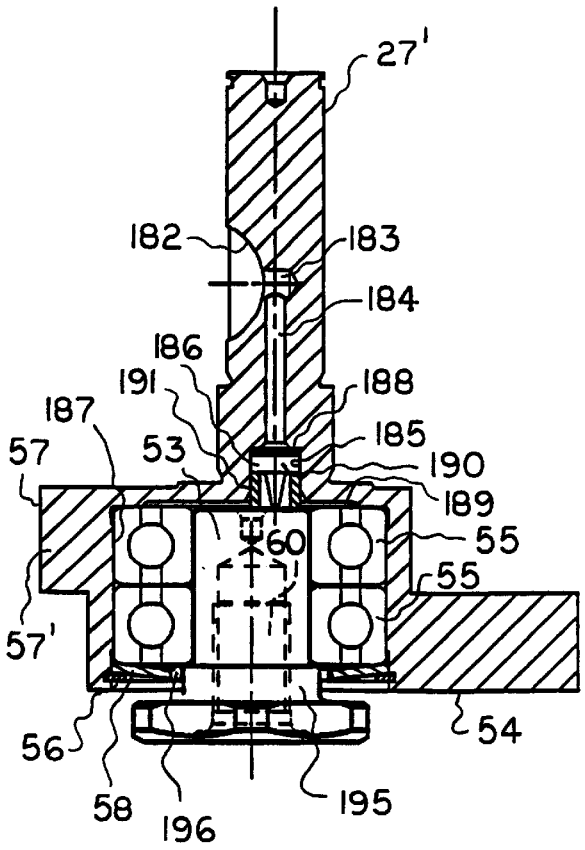
FIG. 17 is a cross sectional view taken substantially along line 17—17 of FIG. 1F and showing a modification of the rotor shaft for positively pressurizing the bearings in the eccentric housing.
Figure 18:
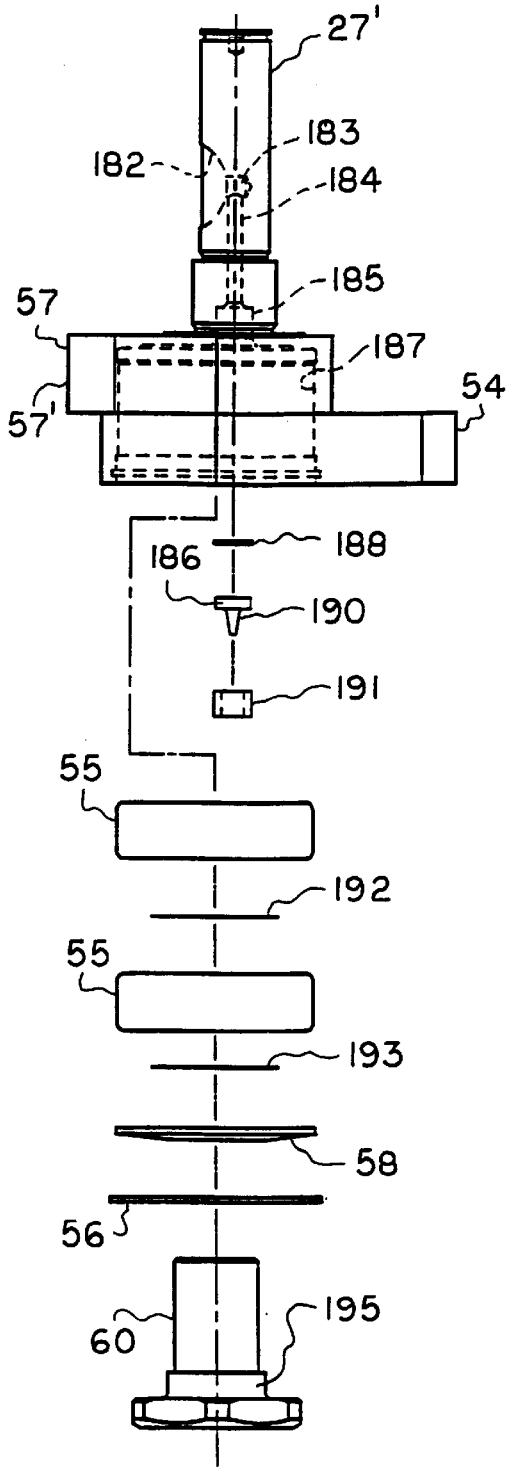
FIG. 18 is an exploded view of the rotor shaft and related structure of FIG. 17.

In accordance with one embodiment of the present invention, the shaft 27 of the air motor has been modified to be shaft 27' shown in FIGS. 17 and 18. In this respect, a cross bore 183 has been drilled in shaft 27', and a coaxial duct in the form of a bore 184 has been drilled in the lower part of shaft 27' in communication with bore 183, and a counterbore 185 has been drilled in the lower end of bore 184. Counterbore 185 is in communication with the chamber 187 of eccentric housing 57 in which bearings 55 are located. As can be seen from FIGS. 1A and 17, there is a small space 189 in chamber 187 above the uppermost bearing 55. A filter disc 188, which is fabricated of spun-bonded polyester, and a duckbill one-way valve 190 are located in counterbore 185 and retained therein by retaining sleeve 191 which is press-fitted into counterbore 185 and bears against the enlarged annular portion 186 of valve 190. The filter 188 filters the compressed air passing through the duckbill valve. As shown in FIG. 18, there is a spacer 192 between bearings 55, and there is a spacer 193 between lower bearing 55 and Belleville washer 58. Spacers 192 and 193 are thin annular metal discs which fit on stub shaft 53, and their outer diameters bear on the inner races of bearing 55 without obstructing the spaces between the inner and outer races. The upper spacer 192 spaces the two bearings 55 so that their outer races do not contact each other. The lower spacer 193 also functions somewhat as a labyrinth seal to create a tortuous path back to the lower bearing 55 when air tends to suck upwardly into the lower bearing 55 when the motor stops. The foregoing structure thus causes air flow into chamber 187 and through bearings 55 and through the annular space 196 between Belleville washer 58 and portion 195 of stub shaft or spindle 53 into the space above sanding disc 14. This pressure is more positive than the pressure outside of eccentric housing 57, thereby preventing sanding dust and other foreign materials from entering bearings 55 in chamber 187 from the area above pad 14. It is to be noted that since duckbill valve 190 is a one-way valve, the air in chamber 187 cannot be drawn back into bore 184 when the air motor inherently functions as a pump when the compressed air flow thereto is terminated, thereby obviating the induction of foreign material laden air into chamber 187.

Figure 19:
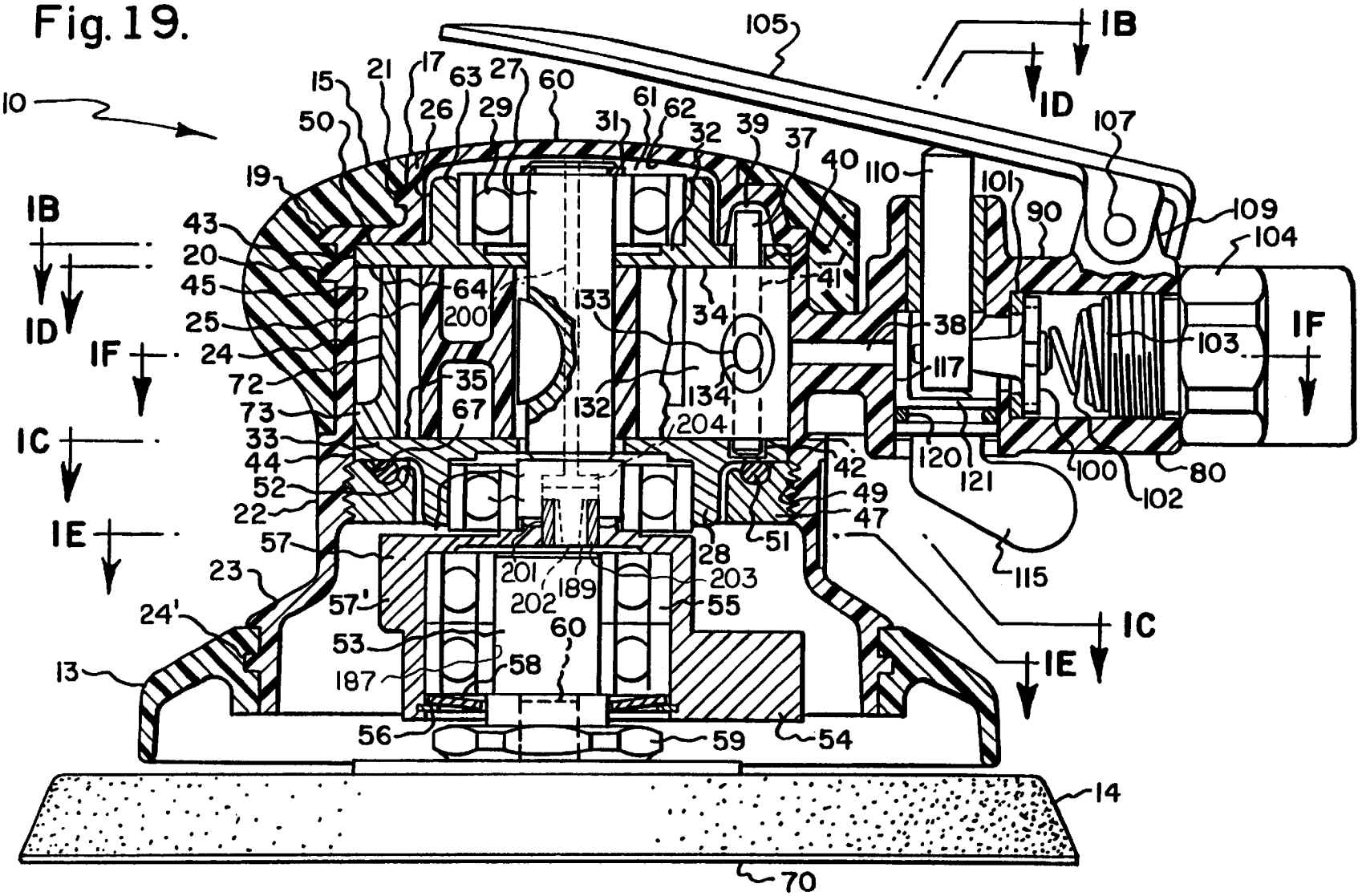
FIG. 19 is a modified form of FIG. 1A showing another embodiment for conducting compressed air to the bearings in the eccentric housing.

In FIG. 19 another embodiment of the present invention is disclosed. All parts which are identical to the numerals in FIG. 1A represent identical elements of structure. In FIG. 19 motor shaft 27 has been modified by creating a duct in the form of a bore 200 therein which extends from the top of shaft 27 to counterbore 201 which is in communication with space 189 within eccentric housing chamber 187. A duckbill valve 202 is located in counterbore 201 and is retained therein by press-fitted sleeve 203, as in the embodiment of FIGS. 17 and 18. A filter 204 which is of the same type described above and designated 188 is located above valve 202 within counterbore 201.

Bore 200 receives its air from clearance space 61. In this respect, there is leakage between shaft 27 and plate 32, and this air also passes through upper bearing 29 to effect cooling thereof and thereafter it passes into clearance space 61 from which it passes into the top of bore 200 which leads to filter 204 and duckbill valve 202. The air emanating from duckbill valve 202 functions in the same manner as described above relative to duckbill valve 190 of FIGS. 17 and 18.

It is to be especially noted that in the embodiments of FIGS. 17, 18 and 19, the only modification has been to the existing shaft of the random orbital tool, and that there has been no requirement for any ducts in the cylinder 24 in which rotor 25 rotates.

Another way of conducting compressed air to bore 200 in FIG. 19 is to drill a small hole (not shown) in upper plate 32 so that compressed air will pass through this hole, through bearing 29 (FIG. 1A) and through space 61 into duct or bore 200. This hole may receive its air from duct 140' (FIG. 1B) or from the clearance between planar surface 34 of plate 32 and cylinder 24. Also, the hole in plate 32 need not be directed to bearing 29, but may be positioned to communicate with clearance space 61 through the clearance between the planar surface 34 of plate 32 and cylinder 24 and through annular portion 63 (FIG. 1B) of plate 32. Also bore 200 may obtain compressed air because of leakage around the outer circumferential edge 43 of plate 32 into clearance space 61.

Figure 20:
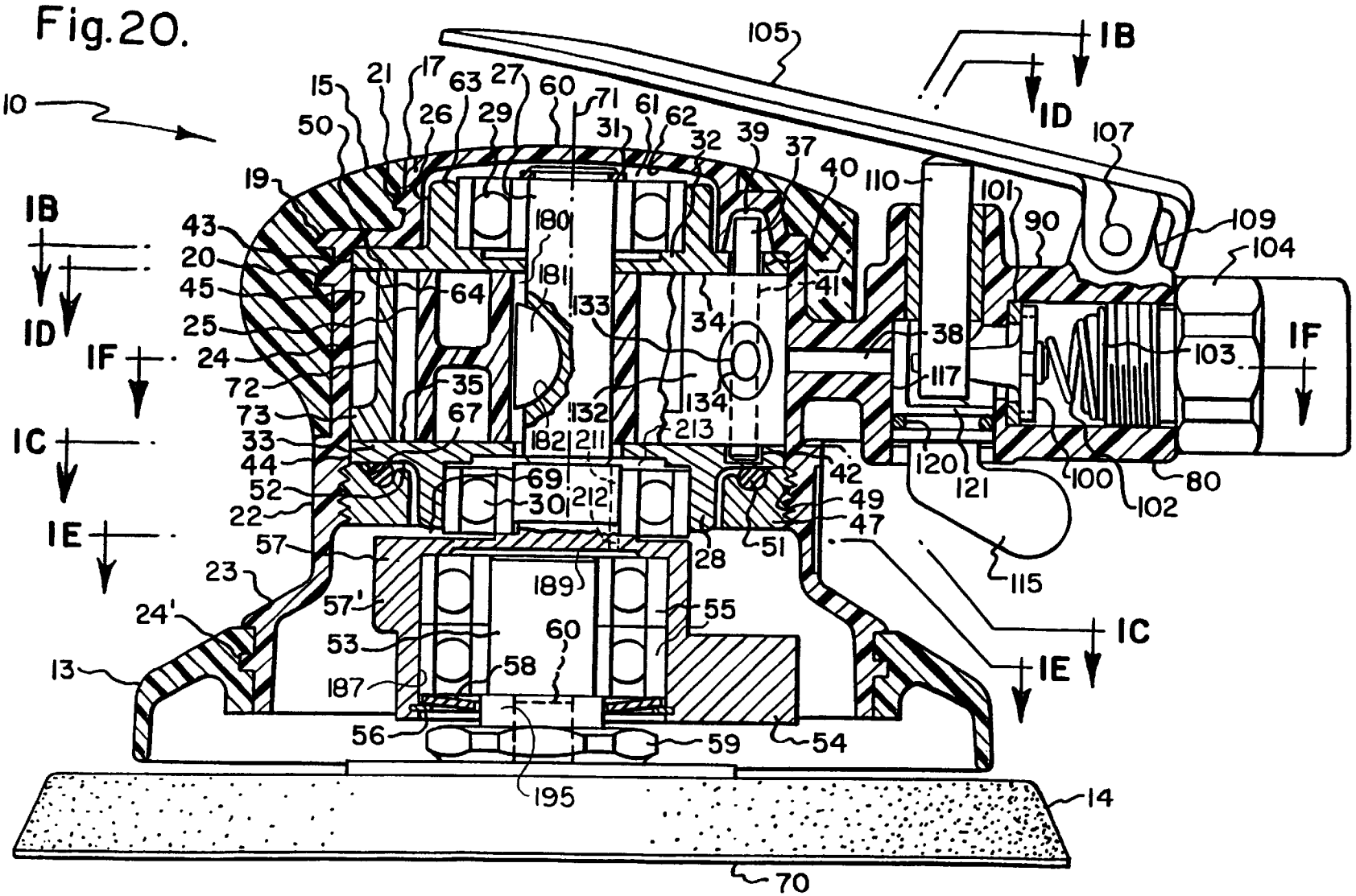
FIG. 20 is a view similar to FIG. 19 and showing a duct in the form of a slot in the rotor shaft for conducting compressed air to the bearing chamber.

Still another way of providing compressed air to bearing chamber 187 is shown in FIG. 20, and it would be to form a duct in the form of a slot 211 on the outside of the portion of shaft 27 which is abreast of bearing 30 and drill a hole 212 in line with slot 211 through the top of housing 57 into chamber 187. Slot 211 would have its open side covered by the contiguous inner race of bearing 30. Compressed air could thus pass from clearance space 213 into bearing chamber 187, the clearance space 213 receiving its compressed air through the clearance between the undersurface of rotor 25 and the planar upper surface of plate 33 and through keyway 180. In this embodiment the compressed air does not pass through a duckbill valve and filter.

Figure 21:
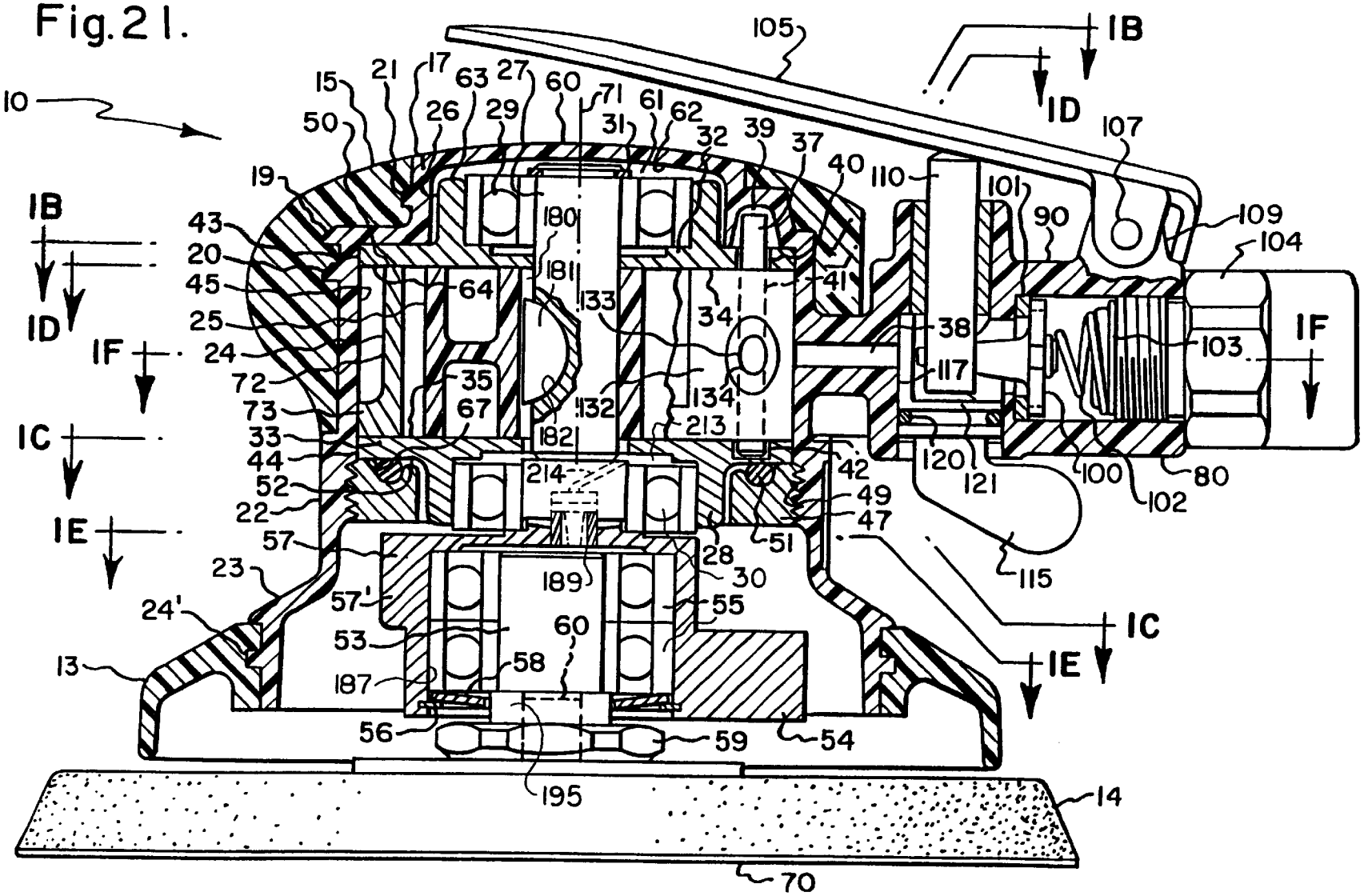
FIG. 21 is a view similar to FIG. 19 and showing another embodiment of a duct which includes an inclined duct or bore in the rotor shaft for conducting compressed air to the bearing chamber.

Another way of conducting compressed air to chamber 187 is shown in FIG. 21 wherein an inclined duct or bore 214 is drilled through the portion of shaft 27 abreast of bearing 30 and duct 214 is in communication with a counterbore (not numbered) housing a filter and duckbill valve, such as shown and described in FIGS. 17–19 so that there is communication between clearance space 213 and small space 189 in chamber 187 through the filter and duckbill valve.

It will be appreciated that the various clearances referred to above through which compressed air passes are considered to be ducts within the housing through which compressed air is conducted to bearing chamber 187.

While preferred embodiments of the present invention have been disclosed, it will be appreciated that it is not limited thereto but may be otherwise embodied within the scope of the following claims.

What is claimed is:

1. A random orbital action surface-treating tool comprising a housing, a compressed air motor in said housing, a shaft in said motor, a rotor mounted on said shaft, compressed air ducts in said motor for conducting compressed air to said rotor, an eccentric housing mounted on said shaft, a chamber in said eccentric housing, at least one bearing in said eccentric housing, and another duct in said shaft in communication with said compressed air ducts and said chamber for conducting compressed air to said chamber and to said at least one bearing in said chamber.

2. A random orbital action surface-treating tool as set forth in claim 1 including a one-way valve in said another duct for permitting flow from said another duct only into said chamber.

3. A random orbital action surface-treating tool as set forth in claim 2 including a filter in said another duct.

4. A random orbital action surface-treating tool as set forth in claim 1 wherein said another duct is a bore in said shaft, and including a keyway in said rotor, a key slot in said shaft, a key in said key slot and extending into said keyway, a clearance between said key and said key slot, a crossbore in said shaft in communication with said key slot, and said crossbore being in communication with said bore in said shaft.

5. A random orbital action surface-treating tool as set forth in claim 4 including a pad having a face connected to said eccentric housing, and wherein said surface-treating tool has a vertical centerline, and wherein said surface-treating tool has a height dimension from the top of its housing to said face of said pad which is less than about 86 millimeters.

6. A random orbital action surface-treating tool as set forth in claim 5 wherein said surface-treating tool has a weight of less than about 0.75 kilograms.

7. A random orbital action surface-treating tool as set forth in claim 4 wherein said surface-treating tool has a weight of less than about 0.75 kilograms.

8. A random orbital action surface-treating tool as set forth in claim 4 including a counterbore in said bore in communication with said chamber, and a one-way valve in said counterbore.

9. A random orbital action surface-treating tool as set forth in claim 8 including a filter in said counterbore.

10. A random orbital action surface-treating tool as set forth in claim 9 wherein said one-way valve is positioned between said filter and said chamber.

11. A random orbital action surface-treating tool as set forth in claim 1 including an upper plate in said housing, an upper bearing in said upper plate supporting said shaft, a first clearance between said upper plate and said shaft, a second clearance between said shaft and said housing, and said another duct in said shaft being in communication with said first clearance through said upper bearing and said second clearance.

12. A random orbital action surface-treating tool as set forth in claim 11 including a pad having a face connected to said eccentric housing, and wherein said surface-treating tool has a vertical centerline, and wherein said surface-treating tool has a height dimension from the top of its housing to said face of said pad which is less than about 86 millimeters.

13. A random orbital action surface-treating tool as set forth in claim 12 wherein said surface-treating tool has a weight of less than about 0.75 kilograms.

14. A random orbital action surface-treating tool as set forth in claim 11 wherein said surface-treating tool has a weight of less than about 0.75 kilograms.

15. A random orbital action surface-treating tool as set forth in claim 11 wherein said another duct is a bore in said shaft, and including a counterbore in said bore in communication with said chamber, and a one-way valve in said counterbore.

16. A random orbital action surface-treating tool as set forth in claim 15 including a filter in said counterbore.

17. A random orbital action surface-treating tool as set forth in claim 16 wherein said one-way valve is positioned between said filter and said chamber.

18. A random orbital action surface-treating tool as set forth in claim 1 including a pad having a face connected to said eccentric housing, and wherein said surface-treating tool has a vertical centerline, and wherein said surface-treating tool has a height dimension from the top of its housing to said face of said pad which is less than about 86 millimeters.

19. A random orbital action surface-treating tool as set forth in claim 18 wherein said height dimension is about 83 millimeters.

20. A random orbital action surface-treating tool as set forth in claim 18 wherein said surface-treating tool is a sander of the central vacuum type and wherein said dust discharge tube has a tube centerline, and wherein the horizontal distance between said vertical centerline and said outer end of said dust discharge tube at said tube centerline is between about 120 and 140 millimeters.

21. A random orbital action surface-treating tool as set forth in claim 18 wherein said surface-treating tool is a sander of the self-generated vacuum type and wherein said dust discharge tube has a tube centerline, and wherein the horizontal distance between said vertical centerline and said outer end of said dust discharge tube at said tube centerline is between about 137 and 157 millimeters.

22. A random orbital action surface-treating tool as set forth in claim 18 wherein said surface-treating tool has a weight of less than about 0.75 kilograms.

23. A random orbital action surface-treating tool as set forth in claim 22 wherein said weight is about 0.68 kilograms.

24. A random orbital action surface-treating tool as set forth in claim 22 wherein said surface-treating tool is a sander of the central vacuum type and wherein said dust discharge tube has a tube centerline, and wherein the horizontal distance between said vertical centerline and said outer end of said dust discharge tube at said tube centerline is between about 120 and 140 millimeters.

25. A random orbital action surface-treating tool as set forth in claim 22 wherein said surface-treating tool is a sander of the self-generated vacuum type and wherein said dust discharge tube has a tube centerline, and wherein the horizontal distance between said vertical centerline and said outer end of said dust discharge tube at said tube centerline is between about 137 and 157 millimeters.

26. A random orbital action surface-treating tool as set forth in claim 19 wherein said weight is about 0.68 kilograms.

27. A random orbital action surface-treating tool as set forth in claim 19 wherein said surface-treating tool has a weight of less than about 0.75 kilograms.

28. A random orbital action surface-treating tool as set forth in claim 1 wherein said surface-treating tool has a weight of less than about 0.75 kilograms.

29. A random orbital action surface-treating tool as set forth in claim 1 wherein said weight is about 0.68 kilograms.

30. A random orbital action surface-treating tool as set forth in claim 1 wherein said another duct is a slot in the outside of said shaft.

31. A random orbital action surface-treating tool as set forth in claim 30 including a second bearing mounting said shaft, and wherein said slot is located adjacent said second bearing.

32. A random orbital action surface-treating tool as set forth in claim 1 wherein said another duct is an inclined bore in said shaft.

33. A random orbital action surface-treating tool comprising a housing, a compressed air motor in said housing, a shaft in said motor, a rotor mounted on said shaft, compressed air ducts in said motor for conducting compressed air to said rotor, an eccentric housing mounted on said shaft, a chamber in said eccentric housing, at least one bearing in said eccentric housing, and ducts within said housing between said compressed air ducts and said chamber proximate said rotor.

34. A random orbital action surface-treating tool as set forth in claim 33 including a pad having a face connected to said eccentric housing, and wherein said surface-treating tool has a vertical centerline, and wherein said surface-treating tool has a height dimension from the top of its housing to said face of said pad which is less than about 86 millimeters.

35. A random orbital action surface-treating tool as set forth in claim 34 wherein said surface-treating tool has a weight of less than about 0.75 kilograms.

36. A random orbital action surface-treating tool as set forth in claim 33 wherein said surface-treating tool has a weight of less than about 0.75 kilograms.

37. A random orbital action surface-treating tool as set forth in claim 33 including a pad having a face connected to said eccentric housing, and wherein said surface-treating tool has a vertical centerline, and wherein said surface-treating tool has a height dimension from the top of its housing to said face of said pad which is between about 83 millimeters and 86 millimeters.

38. A random orbital action surface-treating tool as set forth in claim 37 wherein said surface-treating tool has a weight of between about 0.68 kilograms and 0.75 kilograms.

39. A random orbital action surface-treating tool as set forth in claim 33 wherein said surface-treating tool has a weight of between about 0.68 kilograms and 0.75 kilograms.

* * * * *

UNITED STATES PATENT AND TRADEMARK OFFICE

CERTIFICATE OF CORRECTION

PATENT NO. : 6,257,970 B1
DATED : July 10, 2001
INVENTOR(S) : Paul W. Huber

It is certified that error appears in the above-identified patent and that said Letters Patent is hereby corrected as shown below:

Column 16, claim 33,
Line 2, after "and" insert -- the side of --.

Signed and Sealed this

Twenty-ninth Day of January, 2002

*Attest:*

*Attesting Officer*

JAMES E. ROGAN
*Director of the United States Patent and Trademark Office*